US008965185B2

(12) United States Patent
Doherty et al.

(10) Patent No.: US 8,965,185 B2
(45) Date of Patent: Feb. 24, 2015

(54) INFRARED FURNACE SYSTEM

(75) Inventors: Timothy R. Doherty, Woburn, MA (US); Derek J. Butland, Lowell, MA (US)

(73) Assignee: BTU International, Inc., North Billerica, MA (US)

( * ) Notice: Subject to any disclaimer, the term of this patent is extended or adjusted under 35 U.S.C. 154(b) by 1096 days.

(21) Appl. No.: 12/693,702

(22) Filed: Jan. 26, 2010

(65) Prior Publication Data

US 2010/0220983 A1 Sep. 2, 2010

Related U.S. Application Data

(60) Provisional application No. 61/156,588, filed on Mar. 2, 2009.

(51) Int. Cl.

| | |
|---|---|
| ***F26B 3/30*** | (2006.01) |
| ***F28D 15/00*** | (2006.01) |
| ***F26B 3/28*** | (2006.01) |
| ***F26B 15/12*** | (2006.01) |

(52) U.S. Cl.

CPC ..... *F26B 3/283* (2013.01); *F26B 15/12* (2013.01)

USPC ..... 392/411; 165/104.19

(58) Field of Classification Search

USPC ..... 219/620, 638, 653–658, 701, 700, 711, 219/85.17, 79, 388–414; 392/407–440

See application file for complete search history.

(56) References Cited

U.S. PATENT DOCUMENTS 1,762,299 A 6/1930 Isley
2,282,875 A 5/1942 Mueller (Continued)

FOREIGN PATENT DOCUMENTS

WO WO 92/07224 4/1992

OTHER PUBLICATIONS

International Search Report mailed Apr. 15, 2010 in International Application No. PCT/US2010/023820 filed Feb. 11, 2010.

*Primary Examiner* — Henry Yuen
*Assistant Examiner* — Thomas Ward
(74) *Attorney, Agent, or Firm* — Preti Flaherty Beliveau & Pachios LLP

(57) ABSTRACT

An infrared furnace system provides for adjusting the amount of time a workpiece spends in a respective section of the furnace while at the same time minimizing the footprint, i.e., the amount of floor space that the furnace uses. Various embodiments allow for optimizing the required thermal duration of each section which then also optimizes the heating and/or cooling profile within each section. Transfer conveyors are provided to transfer a workpiece from one conveyor operating at a first speed to a second conveyor operating at a second speed, different from the first speed in order to prevent damage to the workpiece. Rollers are provided to support the workpiece and to maintain a proper orientation. A heating lamp support assembly provides power to the lamp and facilitates exchange and replacement of the lamp. An air delivery system provides process gas maintained at the correct temperature. An exhaust system provides air flow with improved turnover and reduced noise considerations. Infrared heating lamps are cooled by providing gas flow across the end terminals. The wavelength of light emitted by the heating lamps is adjusting by controlling parameters of the process gas being introduced into a section of the furnace.

26 Claims, 19 Drawing Sheets

(56) References Cited

U.S. PATENT DOCUMENTS

| | | | | | |
|---|---|---|---|---|---|
| 2,589,677 | A | | 3/1952 | Darney et al. | |
| 3,751,657 | A | * | 8/1973 | Sangiamo et al. | 362/294 |
| 4,477,718 | A | * | 10/1984 | Crain et al. | 219/388 |
| 4,517,448 | A | | 5/1985 | Crain et al. | |
| 4,600,181 | A | | 7/1986 | Falco et al. | |
| 4,725,716 | A | * | 2/1988 | Entwistle et al. | 219/388 |
| 4,790,428 | A | | 12/1988 | Ramsey | |
| 4,876,437 | A | | 10/1989 | Kondo | |
| 4,894,517 | A | * | 1/1990 | Oguri | 219/388 |
| 5,246,477 | A | | 9/1993 | Kramer | |
| 5,373,893 | A | | 12/1994 | Eisenmann et al. | |
| 5,433,368 | A | * | 7/1995 | Spigarelli | 228/8 |
| 2001/0030184 | A1 | | 10/2001 | Richert et al. | |
| 2002/0146657 | A1 | | 10/2002 | Anderson et al. | |
| 2006/0127068 | A1 | * | 6/2006 | Yadav et al. | 392/416 |
| 2010/0126155 | A1 | * | 5/2010 | Garcia et al. | 60/317 |

* cited by examiner

INFRARED FURNACE SYSTEM

RELATED APPLICATIONS

This application is a non-provisional application claiming priority from U.S. Provisional Patent Application Ser. No. 61/156,588 for "Infrared Furnace System," filed Mar. 2, 2009, and which is incorporated by reference herein for all purposes.

BACKGROUND OF THE INVENTION

Solar or photovoltaic cells are manufactured by depositing conductive inks in desired patterns on the tops and bottoms of a solar cell wafer. The wafers are thermally processed in a furnace system to dry the conductive ink and burn off binders and other materials and then to fire the materials to form metallization patterns on the wafer surfaces. Furnace systems for such metallization processes typically employ infrared heating to provide the rapid thermal processing environment needed for processing the wafers.

Known wafer firing furnaces can be generally characterized as comprising three sections: a drying zone at an entrance where wafers are loaded into the furnace, a burnout/firing zone, generally thought of as the middle zone, and a cooling section located at the end and having an exit from which the wafers are removed. In many wafer firing furnaces, the conveyors used for processing the wafers through the sections are usually single-belt structures where the same belt is subjected to the different temperatures according to which section the portion of the belt is located.

A furnace with only a single conveyor belt running through its entire length, however, provides a process that has only one rate of speed for passing the wafers through the system. Accordingly, this single rate of speed limits the thermal profile experienced by a wafer as it passes through the furnace on the conveyor belt. If it is necessary to change the amount of time a wafer spends within a section of the furnace, the belt speed must be increased or decreased, which then also changes the duration the wafer experiences in the other sections of the system.

It is known that a second conveyor belt and drive may be placed in the burnout/firing zone of the furnace, in order to shorten the duration of the temperature spike without reducing the temperature peak, by running the second conveyor belt at an increased speed as compared to the speed in the other zones of the furnace. Providing a second belt, however, presents issues as to how to either receive or transfer a wafer from/to a belt that is running at a different speed, i.e., relatively slower or faster, than the current belt, without damaging the wafer in the process.

What is needed is a wafer processing furnace that provides flexibility for altering the thermal profile in various sections of the furnace so that each furnace segment may be individually adjusted without adversely affecting another furnace section.

BRIEF SUMMARY OF THE INVENTION

In one embodiment of the present invention, an infrared furnace system includes multiple sections, e.g., drying, burnout/firing, and cooling, each having a separate conveyor belt so that a workpiece may travel through a respective section at a rate that is different from the rate at which the workpiece may pass through any other section. Advantageously, the present infrared furnace allows for the adjusting of the amount of time a workpiece spends in a respective section of the furnace while at the same time minimizing the footprint, i.e., the amount of floor space that the furnace uses. Adjusting the dwell time allows for optimizing the required thermal duration of each section which then also optimizes the heating and/or cooling profile within each section.

In another embodiment of the present invention, transfer conveyors are provided to transfer a workpiece from one conveyor operating at a first speed to a second conveyor operating at a second speed, different from the first speed. The transfer conveyors prevent damage to the workpiece by preventing the workpiece from being on two different conveyor belts where each belt is travelling at a different speed from the other. Rollers are provided to support the workpiece and to maintain a proper orientation of the workpiece as it is moved to the next section.

One embodiment of the present invention provides a heating lamp support or trigger assembly that provides power to the heating lamps and facilitates exchange and replacement of the heating lamps. The trigger support includes a trigger support front panel portion and a trigger support back portion coupled to one another. A plurality of trigger pods are defined in the trigger support back portion. The trigger support provides the trigger pods to receive a respective trigger. The trigger includes a lamp connector that protrudes through a respective trigger opening to be in contact with a respective lamp. The trigger is maintained in position by an internal spring. When the trigger is pulled in a direction opposite of the spring's force, the corresponding heating lamp is disengaged and can be removed or replaced.

In yet another embodiment, a furnace comprises a first section having one or more zones, at least one conveyor for conveying a product, an entrance and an exit; a second section having one or more zones, at least one conveyor for conveying a product, an entrance and an exit; and a third section having one or more zones, at least one conveyor for conveying a product, an entrance and an exit. At least one of the first, second and third sections includes an array of lamps disposed either above or below the respective at least one product conveyor with each lamp comprising an elongated tubular region located between first and second end terminals. At least one of the first, second and third sections includes a lamp cooling system for cooling the end terminals of the lamps.

In another embodiment of the present invention, process gas is removed through exhaust piers provided between zones of the furnace. An exhaust pier is provided above and below the conveyor belt and helps to delineate the different zones. Each exhaust pier includes an exhaust pipe that is used to vent the process gas out from the zone. The exhaust pipe may include an upper exhaust pipe and a lower exhaust pipe. The upper and lower exhaust pipes feed into a Venturi section that is coupled to an exhaust stack. Each of the upper and lower exhaust pipes has a plurality of holes located therealong in order to pull in the gas to be vented to the outside of the system. The mechanism for providing the suction force for pulling the processed gas out of the zone includes a right angle high pressure pipe inserted in the sidewall of the Venturi section. A compression fitting is coupled to a distal end of the high pressure pipe and an air nozzle is coupled to the compression fitting. In operation, high pressure air on the order of 80 psi is provided into the proximal end of the high pressure pipe and ejected from the air nozzle. Due to the Venturi effect, this creates a draw behind the air coming out of the air nozzle and causes air to be drawn in through the holes. Advantageously, using the air nozzle at this air pressure level provides sufficient movement of air, on the order of approximately 71 cubic feet per minute.

BRIEF DESCRIPTION OF THE SEVERAL VIEWS OF THE DRAWINGS

Embodiments of the present invention may be better understood by referring to the following description in conjunction with the accompanying drawings in which.

Figure 1:
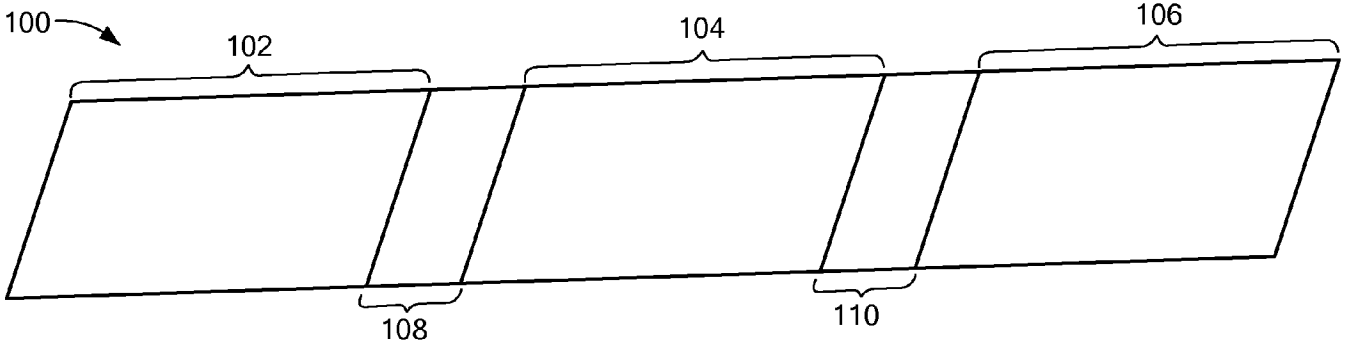
FIG. 1 is a block diagram of an infrared furnace system in accordance with an embodiment of the present invention.

It will be appreciated that for simplicity and clarity of illustration, elements shown in the drawings have not necessarily been drawn accurately or to scale. For example, the dimensions of some of the elements may be exaggerated relative to other elements for clarity or several physical components may be included in one functional block or element. Further, where considered appropriate, reference numerals may be repeated among the drawings to indicate corresponding or analogous elements. Moreover, some of the blocks depicted in the drawings may be combined into a single function.

DETAILED DESCRIPTION OF THE INVENTION

The entire contents of U.S. Provisional Patent Application Ser. No. 61/156,588 for "Infrared Furnace System," filed Mar. 2, 2009, is incorporated by reference herein for all purposes.

In the following detailed description, numerous specific details are set forth in order to provide a thorough understanding of the embodiments of the present invention. It will be understood by those of ordinary skill in the art that these embodiments of the present invention may be practiced without some of these specific details. In other instances, well-known methods, procedures, components and structures may not have been described in detail so as not to obscure the embodiments of the present invention.

As will be described in more detail below, an infrared furnace system, in accordance with various embodiments of the present invention, provides a system that allows for adjusting the amount of time a wafer spends in a respective section of the furnace while at the same time minimizing the footprint, i.e., the amount of floor space that the furnace uses. Advantageously, various embodiments of the present invention allow for optimizing the required thermal duration of each section which then also optimizes the heating and/or cooling profile within each section.

It is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein are for the purpose of description and should not be regarded as limiting.

Further, certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

In accordance with various embodiments of the present invention, a furnace is provided with multiple belts. In one embodiment, one belt is provided per section of the furnace. Providing a furnace with multiple belts allows for the aforementioned flexibility in adjusting the amount of time a workpiece, for example, a solar cell wafer, spends in each section of the furnace because the speed of the respective conveyor belt can be individually adjusted. Further, the conveyor belt mesh size in one section may be different than that of another section, thereby allowing improved heating or cooling capacity or air-flow of each section. Further, embodiments of the present invention provide for a safe and reliable transfer of a wafer from one conveyor belt to the next, along with maintaining proper alignment of the wafer as it transitions from one belt to the next because the wafer is realigned by removing any rotational error the wafer may accumulate as it transitions from one belt to the next.

These advantages, along with other advantages that can be obtained by various embodiments of the present invention, will be described in more detail below.

It is to be appreciated that various embodiments of the methods and apparatuses discussed herein are not limited in application to the details of construction and arrangement of components or steps set forth in the following description or illustrated in the accompanying drawings. The methods and apparatuses are capable of implementation by other embodiments that are being practiced or being carried out in various ways. Examples of specific implementations or embodiments are provided herein for illustrative purposes only and are not intended to be limiting. Particular acts, elements and features discussed in connection with any one of the embodiments are not intended to be excluded from a similar role in any other embodiments. Also, the phraseology and terminology used herein are for the purposes of description and should not be regarded as limiting. The use herein of "including," "comprising," "having," "containing," "involving," and variations thereof, is meant to encompass the items listed thereafter and equivalents thereof, as well as additional items.

Referring now to FIG. 1, an infrared furnace system 100 includes a drying section 102, a burnout/firing section 104 and a cooling section 106 arranged, generally as is known, one after the other in series. A first transfer section 108 is located between the dryer section 102 and the burnout/firing section 104. A second transfer section 110 is located between the burnout/firing section 104 and the cooling section 106.

Figure 2:
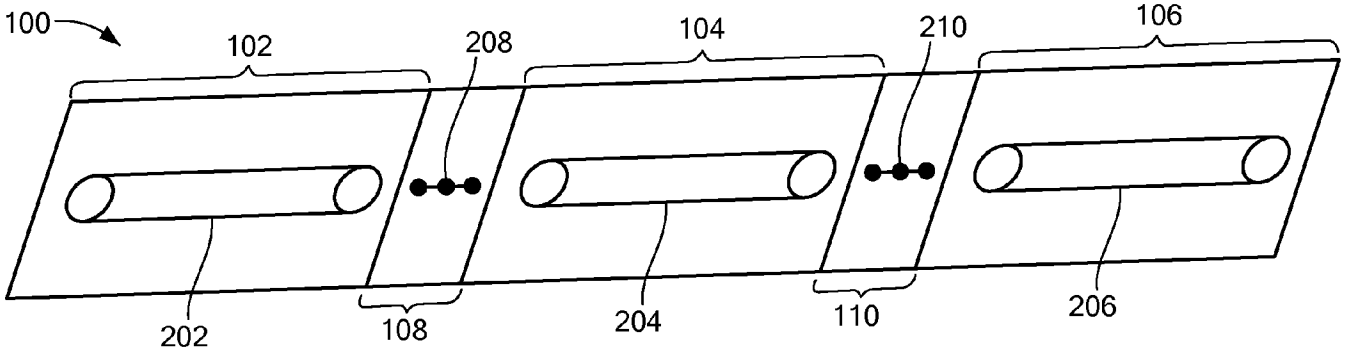
FIG. 2 is a cutaway view of the infrared furnace system shown in FIG. 1.

As shown in FIG. 2, a dryer conveyor belt 202 is provided within the dryer section 102, a burnout/firing conveyor belt 204 is provided within the burnout/firing section 104 and a cooling conveyor belt 206 is provided within the cooling section 106.

A first transfer conveyor 208 is provided in the first transfer section 108 and a second transfer conveyor 210 is provided in the second transfer section 110.

In operation, an object to be processed, for example, a solar cell wafer, is provided to an entrance of the dryer section 102 and conveyed through the dryer section 102 by the dryer conveyor belt 202. In one embodiment of the present invention, one or more infrared panel heaters are disposed in an upper portion of the dryer section 102. These infrared panel heaters are disposed along the length of the dryer section 102 and, generally, the dryer conveyor belt 202 passes underneath or between them. In one embodiment, the infrared panel heaters may have a glass ceramic surface and the infrared heating elements may be disposed above the glass ceramic surface such that the glass ceramic surface is between the wafer and the infrared heating element. This arrangement is similar to the glass top cooking ranges where the burners are "below" or behind the glass. Advantageously, these panel heaters provide uniform infrared radiation across the entire width and length of the dryer section 102. The glass ceramic surface provides for relatively easy cleaning of dirt or residue therefrom. A bottom portion of the dryer section 102 may include drip trays that collect residue dripping from the wafer as it is heated. Further, in one embodiment, stainless steel panels line the interior of the chamber through which the workpieces are conveyed for ease of cleaning.

At the end of the dryer section 102, the workpiece or wafer is transferred from the dryer conveyor belt 202 to the burnout/firing conveyor belt 204 by operation of the first transfer conveyor 208.

The burnout/firing section 104, sometimes referred to as the "firing process" section, in one embodiment, includes an array of infrared heating lamps provided in each of an upper and lower section for heating of the workpieces being conveyed through the burnout/firing section 104 by the burnout/firing conveyor belt 204. The burnout/firing section 104 may have different zones thereby providing multi-zone operation where different zones have different temperatures that can provided the workpiece with a temperature profile in accordance with the desired process.

When the workpiece has reached the end of the burnout/firing section 104 it is transferred from the burnout/firing conveyor belt 204 to the cooling conveyor belt 206 by operation of the second transfer conveyor 210. Within the cooling section 106 the temperature of the workpiece is brought down to slightly above room temperature under a controlled process so. Similar to the burnout/firing section 104, the cooling section 106 may have various zones set at different temperatures that provides a pre-defined cooling profile to a workpiece as it passes through. The finished piece is then taken off the end of the cooling conveyor belt 206 for post-furnace processing that need not be described herein.

Generally, each transfer conveyor 208, 210 is operative to transport wafers from the conveyor belt of one furnace section to the conveyor belt of the next adjacent furnace section. One of ordinary skill in the art will understand that the number of transfer conveyors needed in any given system is a function of the number of separate sections between which workpieces are transported. Accordingly, a furnace with three sections is described herein, with two transfer conveyors in operation, only for reasons of explanation and not intended to be limiting.

Figure 3:
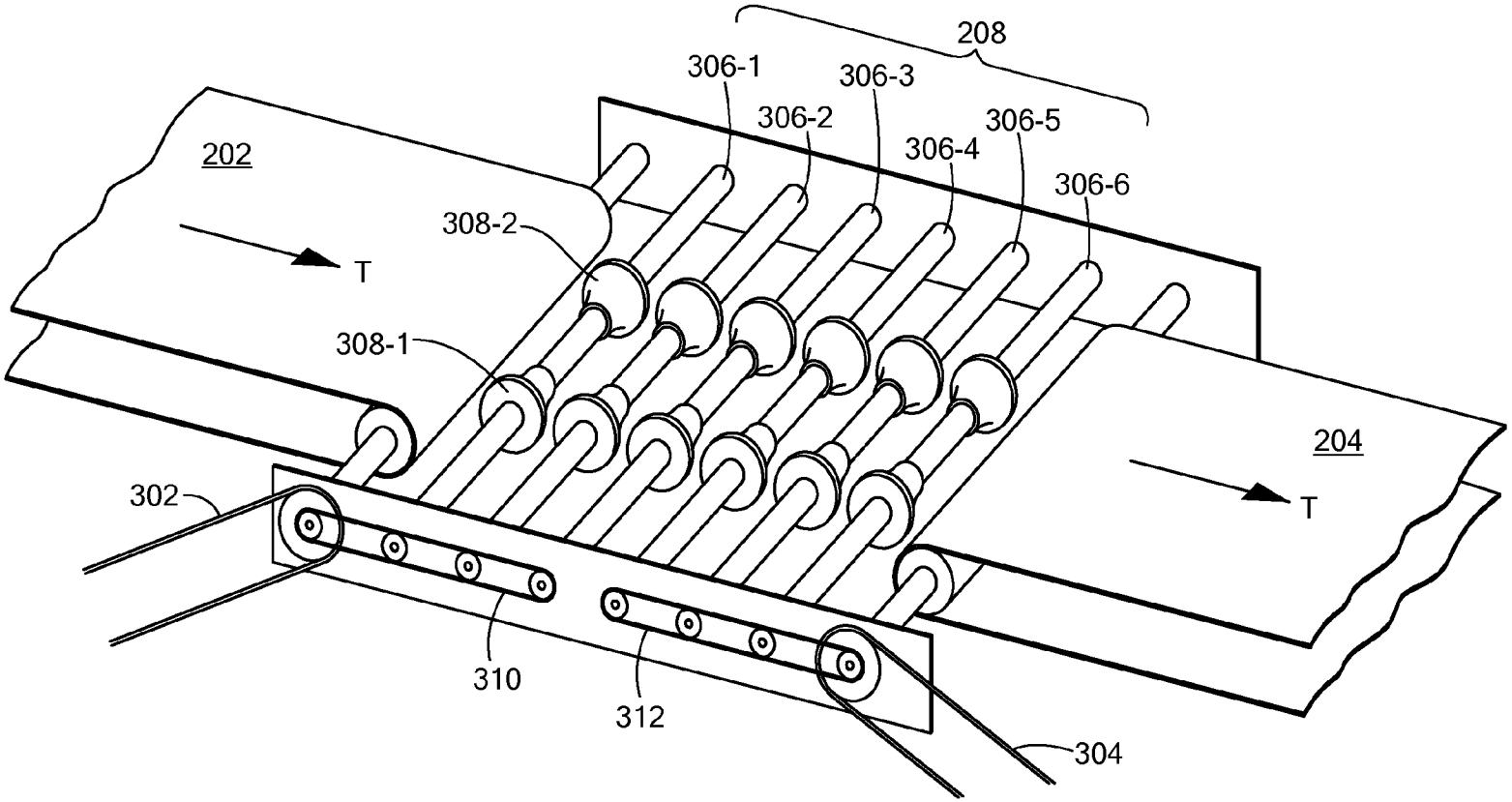
FIGS. 3-6 are various views of a transfer conveyor in accordance with one embodiment of the present invention.

Accordingly, operation of the dryer conveyor belt 202, the first transfer conveyor 208 and the burnout/firing conveyor belt 204 will be described as an example of operation of an embodiment of the system. The first transfer conveyor 208, as shown in FIG. 3, includes a plurality of transfer shafts 306-1 . . . 306-6 that are spaced along the direction of travel, as represented by arrows T. In one embodiment, the dryer conveyor belt 202 is driven by a dryer conveyor belt drive 302 and the burnout/firing conveyor belt 204 is driven by a burnout/firing conveyor belt drive 304. Each of the transfer shafts **306-*n* has two transfer rollers 308-1, 308-2** mounted thereon and sized and spaced to accommodate the wafers or workpieces being conveyed within the system. The rollers may include ceramic bearings with a Teflon® cage to provide better "free-spinning" and movement of the workpiece.

In one embodiment of the present invention, the distance between the transfer rollers 308-1, 308-2 on each transfer shaft **306-*n* may be adjusted depending upon the wafer being processed. Alternatively, the spacing between the transfer rollers 308 may be fixed and the entire transfer shaft 306-*n* replaced with a transfer shaft 306-*n* that has a different spacing between the transfer rollers 308. The transfer rollers 308 are freely rotatable on the respective transfer shaft 306. In the absence of a wafer being supported by the transfer rollers 308, the transfer rollers 308 spin at the same rate of speed as the transfer shaft 306 on which they are mounted, driven only by the rotary inertia and friction forces inherent to the bearings of the transfer rollers 308. The transfer rollers 308** are allowed to spin free so that as a workpiece, e.g., a wafer, is passed from a roller at one speed to a roller at a different speed neither roller spins against the bottom surface of the wafer causing abrasion. The friction force between the roller and the wafer is enough to overcome the inertia that passively drives the rollers so that the rollers will either speed up or slow down to match the speed of the wafer. The wafer slowly accelerates/decelerates to the speed of the second set of rollers as more of those rollers come into contact with the bottom surface of the wafer.

As shown in FIG. 3, the transfer shafts 306-1, 306-2 and 306-3 closest to the dryer conveyor belt 202 are driven by a first belt 310 so as to rotate at the same rate as the sprockets of the dryer conveyor belt 202 which is feeding wafers to the first transfer conveyor 208. Those transfer shafts 306-4, 306-5 and 306-6 closest to the burnout/firing conveyor belt 204 are driven by a second belt 312 so as to rotate at the same rate as the sprockets of the burnout/firing conveyor belt 204 that will receive the wafer or workpiece.

Figure 4:
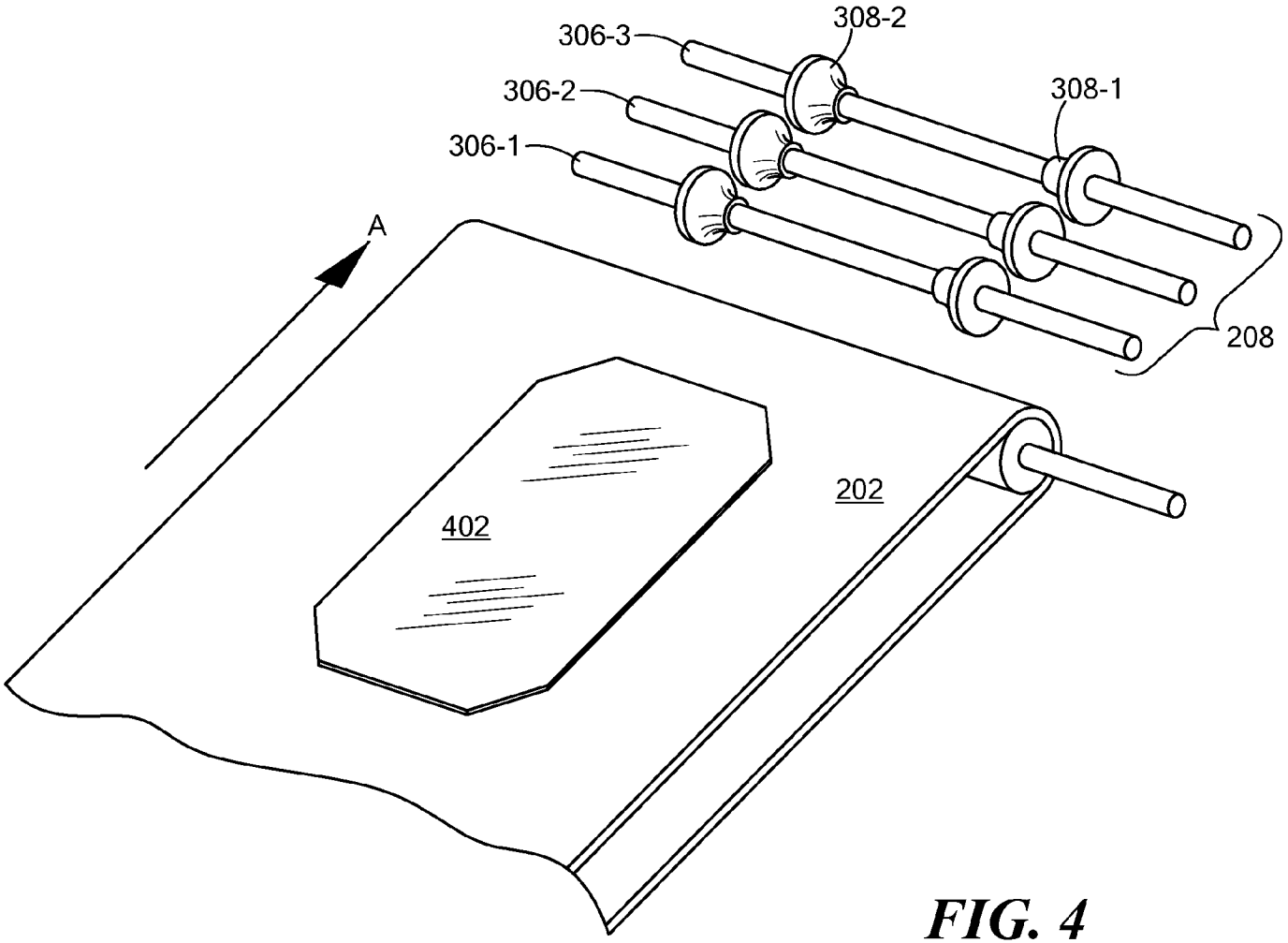

Referring now to FIG. 4, a generally rectangular wafer 402 having angled side edges at opposite ends of the wafer is positioned on the dryer conveyor belt 202. As shown, the wafer 402 will move in a direction A, as represented by the arrow A, toward the transfer shafts 306 of the first transfer conveyor 208. The transfer rollers 308 are shaped to maintain the alignment or, if necessary, realign the wafer 402 as it travels along the conveyor path from the dryer conveyor belt 202 toward the burnout/firing conveyor belt 204. The shape of the transfer rollers 308 will be described in more detail below.

Figure 5:
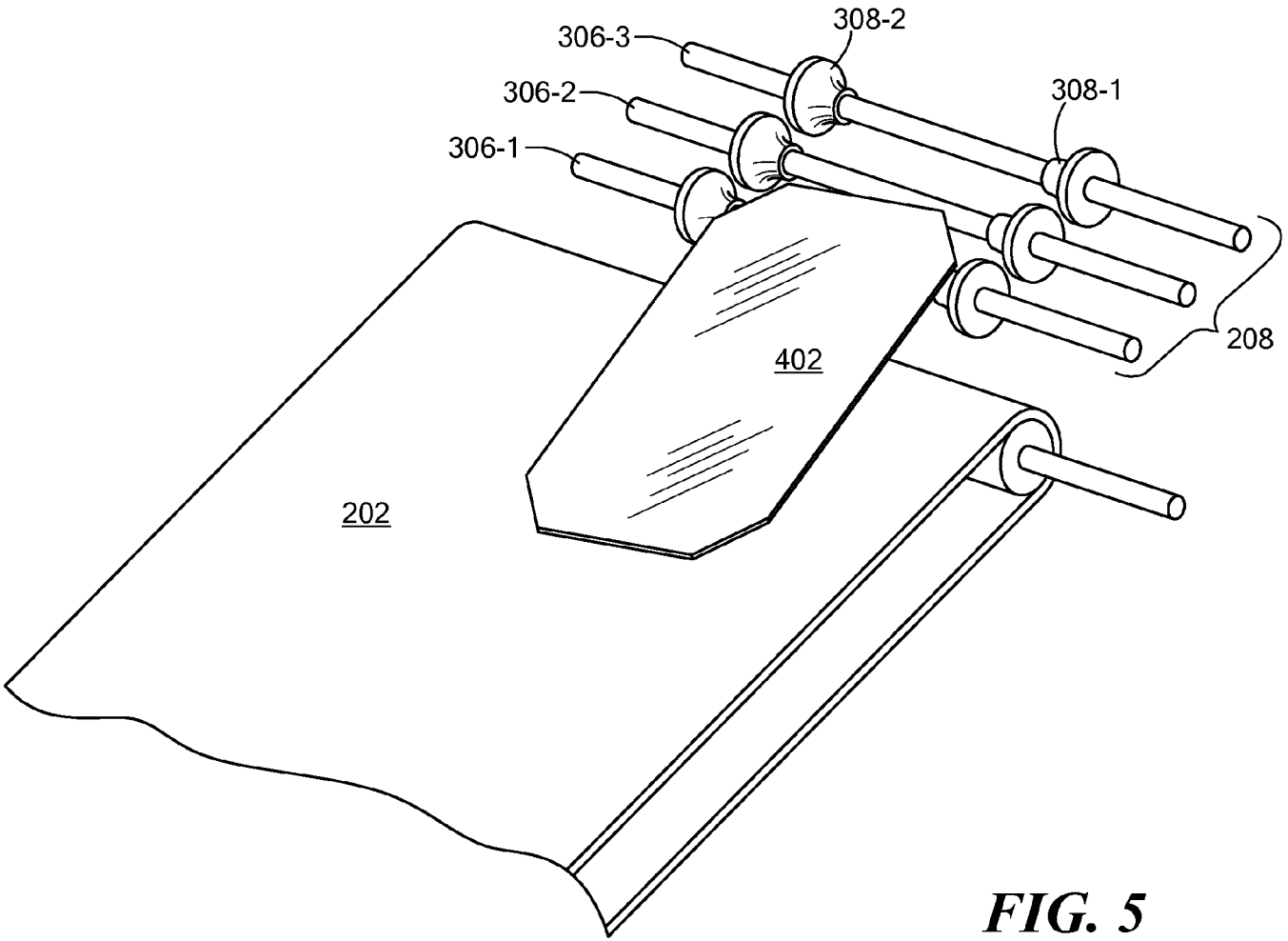
Figure 6:
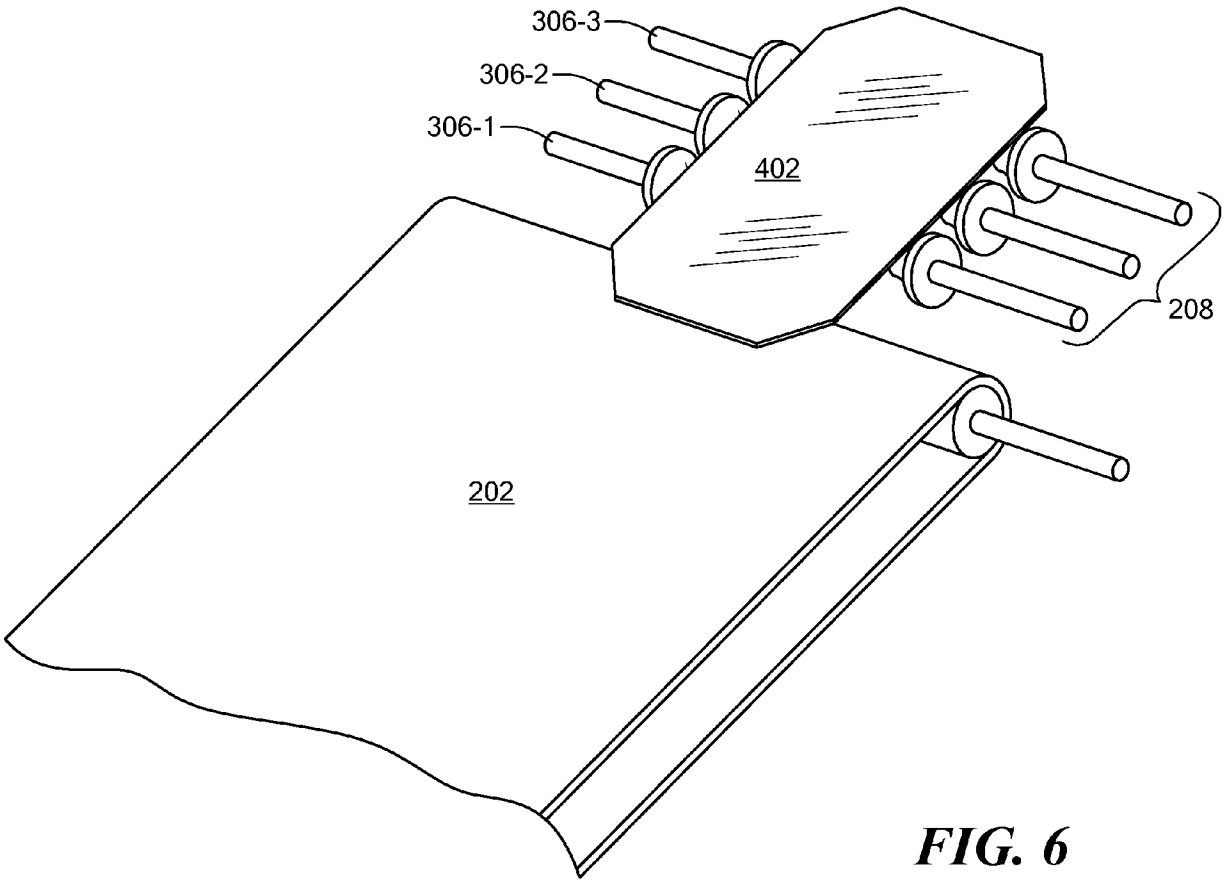

In an event where the wafer 402 becomes skewed, or otherwise misplaced on the conveyor belt 202, as shown in FIG. 5, when the wafer 402 reaches the transfer rollers 308 of the transfer shafts 306, the wafer 402 will be straightened. When the rollers 308 contact a corner of the wafer 402 a realignment of the wafer 402 will then occur. As a result, referring to FIG. 6, the wafer 402 will now be properly oriented within the first transfer conveyor 208 for conveyance onto the burnout/firing conveyor belt 204 by operation of the subsequent transfer shafts 306-4, 306-5 and 306-6.

As above, the transfer shafts 306 located closer to the adjacent conveyor are driven by sprockets which are connected to the drive system of the adjacent conveyor so that the transfer shafts rotate at the same rate as the shafts of the adjacent conveyor to provide the same linear speed. As the transfer rollers 308 are freely rotatable on their respective shafts, the wafers are moved along the transfer section and are transported onto the adjacent conveyor at the speed of that subsequently receiving conveyor.

The transfer rollers are made of a suitable material to not damage the confronting surfaces of the wafer. Typically, this material is a heat resistant plastic such as PEI.

A number of transfer shafts 306 and transfer rollers 308 have been shown for purpose of explanation. It should be noted, however, that a sufficient number of transfer shafts 306 should be provided along the travel path of any of the transfer conveyors such that the wafer 402 rests entirely on transfer rollers 308 as it passes from one conveyor to the next. In other words, a sufficient number of shafts 306 should be provided so that the wafer 402 does not come in contact with two conveyor belts at the same time so as not to damage the wafer 402 due to the difference in speeds between the two conveyers.

One of ordinary skill in the art will understand that while the dryer conveyor belt 202 and the burnout/firing conveyor belt 204 are each shown as being driven by a belt drive apparatus, it is understood that alternate mechanisms for driving the conveyor belt may also be used. These include, but are not limited to, gears, and individual servo controlled motors either on open loop or feedback control. Further, the transfer shafts may be controlled to operate with respect to their respective conveyor belts by operation of gears, individual motors synchronized to the motors or operation of the respective conveyor belt or by any one or more other known and equivalent mechanisms.

Figure 7:
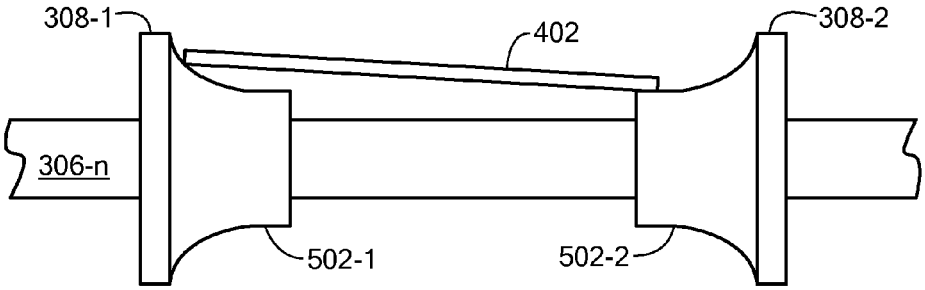
FIGS. 7 and 8 are various views of a wafer travelling on a transfer conveyor.
Figure 8:
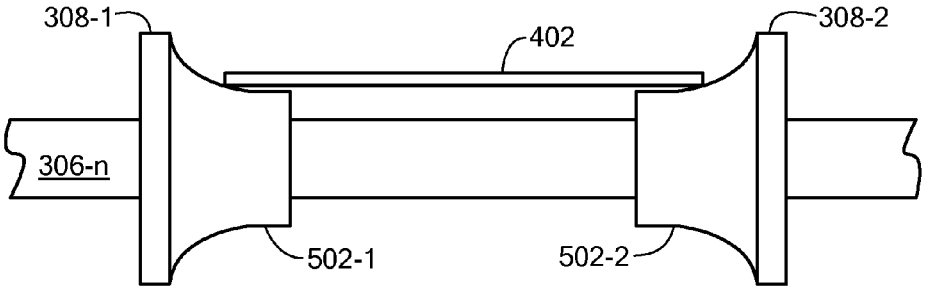

The transfer rollers 308 are shaped to maintain the alignment or to realign the wafers 402 traveling along the transfer conveyor. As shown in FIG. 7, the transfer rollers 308 have a ramped or concave surface 502 that serves to center a wafer 402 on the rollers 308 in the event that the wafer is misaligned in its travel. As shown, when a wafer 402 arrives at the transfer conveyor section, and it is not straight i.e., it is askew, or the central plane of the wafer is not parallel to the central plane of the conveyor, the transfer rollers 308 will contact a wafer corner and realign the wafer. Thus, a misaligned wafer 402 as shown in FIG. 7 will be straightened by the operation of the transfer rollers 308 to result in an oriented wafer 402 as shown in FIG. 8.

When the wafer is offset either laterally or rotationally as it approaches the transfer roller 308, the wafer 402 will be forced away from the higher points of the transfer roller 308 resulting in the wafer moving back to the center of the conveyor. As a result, each transfer conveyor will transport the wafer 402 safely from one furnace section conveyor belt to the next furnace section conveyor belt which may be travelling at the same or different speed. As a typical example, and to better understand the relative speeds of the belts, the conveyor belt of the dryer section may move at 120 inches per minute (ipm) and the conveyor of the burnout/firing section may have a speed of 240 ipm. Further, the conveyor of the cooling section may have a speed of 120 ipm.

In one embodiment of the present invention, the wafer 402 may be off center either left or right from the center of the conveyor belt by up to about a quarter of an inch and the tapered transfer rollers will realign the wafer 402 by re-centering the wafer 402 on the conveyor and at the same time correct any rotational error that the conveyor may have experienced as a result of the wafer 402 traveling along the length of the conveyor.

Alternately, a transfer shaft 306 may comprise a single piece of material configured to provide the support similar to that provided by the transfer rollers 308-1, 308-2. The examples of the transfer shafts 306 are for explanatory purposes only and not otherwise intended to be limiting.

Figure 9:
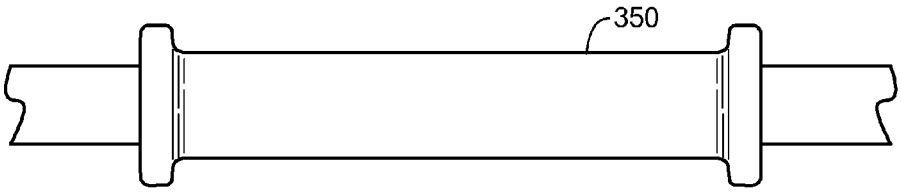
FIGS. 9 and 10 are representations of different embodiments of rollers.
Figure 10:
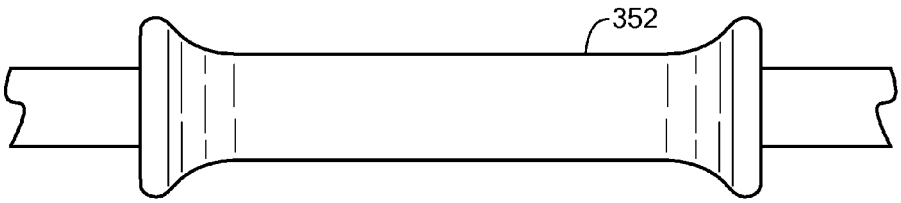

In an alternate embodiment of the present invention, a transfer roller 350 having a flat profile may be provided, as shown in FIG. 9. Further, referring now to FIG. 10, a tapered roller 352 may be provided. Here, the tapered roller 352 may be referred to as having a "dog-bone" shape. The flat roller 350, or the dog-bone roller 352, may be sized to be as wide as a workpiece which will be transported across it. In the case of the flat roller 350, there may not be a requirement to straighten the workpiece out as it moves across, while, alternatively, the dog-bone roller 352 may provide such an orientation function similar to that which has been described above.

Figure 11:
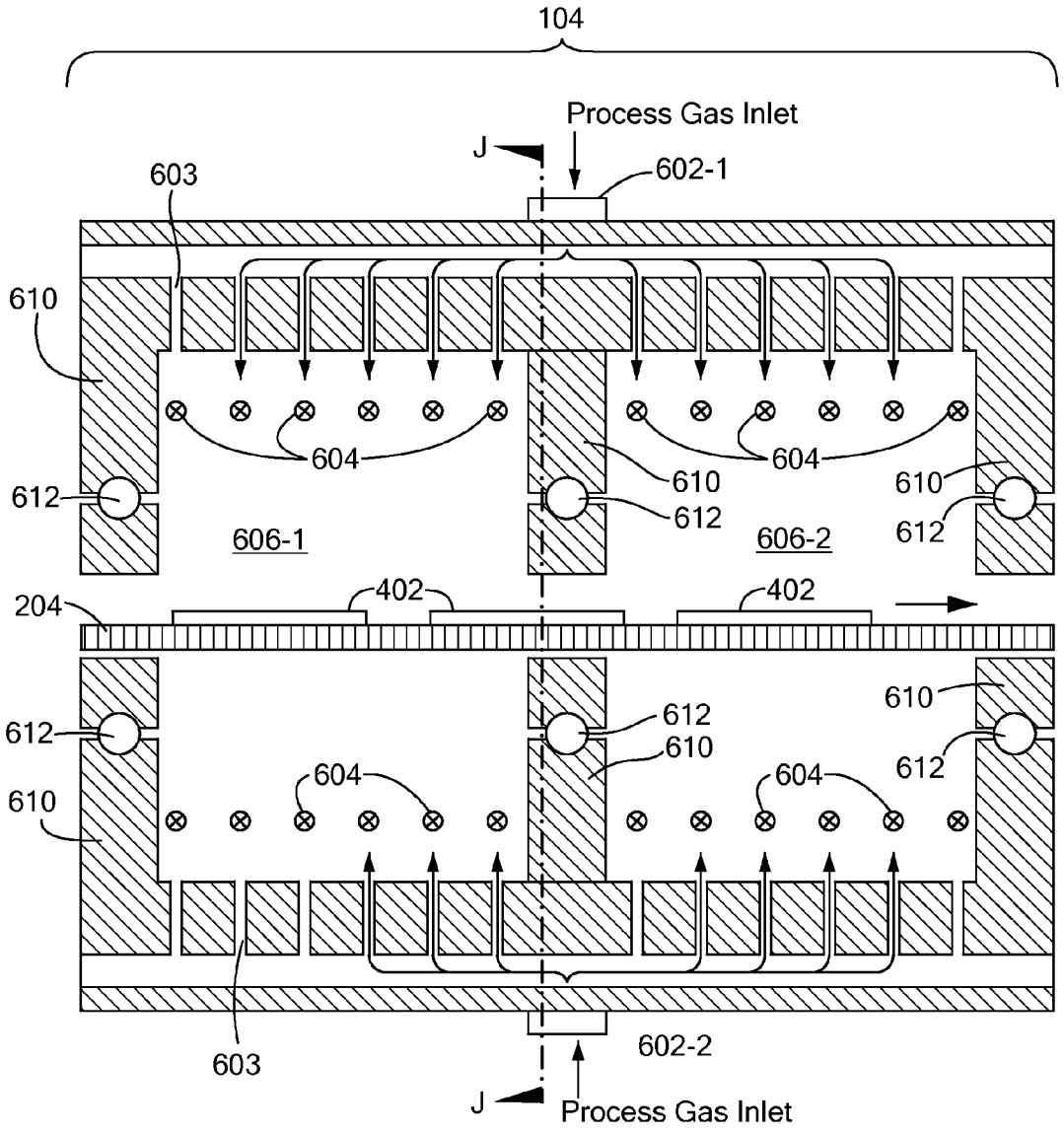
FIGS. 11-13 are cross-sectional views of a section of a furnace in accordance with an embodiment of the present invention.

The burnout/firing section 104, as shown in FIG. 11, includes a process gas inlet 602-1 for introducing process gas into a top side of the burnout/firing section 104 and a second process gas inlet 602-2 for inputting process gas into a bottom side of the burnout/firing section 104. The burnout/firing conveyor belt 204 moves the wafers 402 through the burnout/firing section 104 where the wafers 402 are exposed to infrared heat provided by a plurality of infrared heating lamps 604. Each IR heating lamp 604 includes an elongated quartz tube with a heating element within. These are known to those of skill in the art and need not be described in further detail herein. The lamps are arranged transverse to the direction of travel of the belt and in the FIGS. 11, 12 and 13, therefore are shown as going "into" the drawing sheet. The burnout/firing section 104 may consist of subzones 606 in which the IR heating lamps 604 are set to operate at different temperatures thereby providing the wafer 402 with a specified temperature profile as the wafer 402 is moved along by the burnout/firing conveyor belt 204. The gas is directed through a plurality of slots 603 provided in the furnace housing so as to move past the IR heating lamps 604. The process gas, when moving past the IR heating lamps 604, is heated by the IR heating lamps 604 while at the same time cooling the IR heating lamps 604 by operation of the gas being blown past the IR heating lamps 604.

In order to remove the process gas, exhaust piers 610 are provided between each of the zones 606. An exhaust pier 610 is provided above and below the conveyor belt 204 and helps to delineate the different zones 606. Each exhaust pier 610 includes an exhaust pipe 612 that is used to vent the process gas out from the zone 606.

Figure 14:
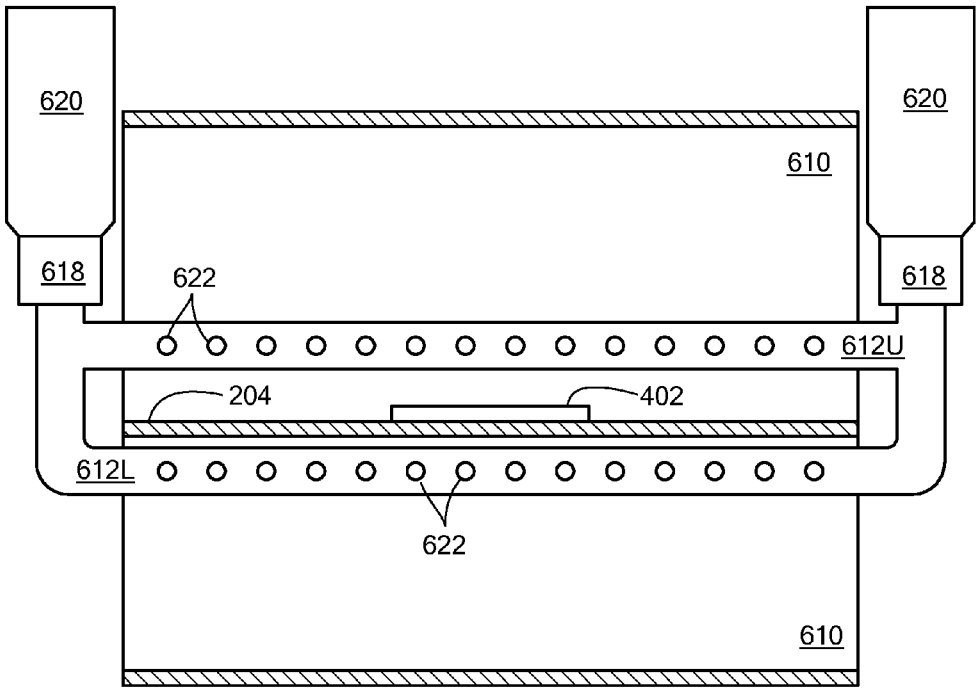
FIG. 14 is a cross-section view of FIG. 11 taken across the line J-J.

Referring now to FIG. 14, a partial cross-section view of the system shown in FIG. 11 taken along the line J-J is presented. As shown in FIG. 14, the conveyor belt 204 is now presented as traveling into the drawing sheet. The exhaust pipe 612, in one embodiment, includes an upper exhaust pipe 612U and a lower exhaust pipe 612L. The upper and lower exhaust pipes 612U and 612L feed into a Venturi section 618 that is coupled to an exhaust stack 620. Each of the upper and lower exhaust pipes 612U, 612L has a plurality of holes 622 located therealong in order to pull in the gas to be vented to the outside of the system. In one embodiment, each of the upper and lower exhaust pipes 612U and 612L includes holes 622 on each side and, dependent upon the location in the system, may pull gas to be exhausted from two different zones. Alternatively, the holes 622 may be provided on only one side of the exhaust pipe in order to only pull from one zone. The location and size of the holes is dependent upon the needs for the removal of gas and is chosen accordingly.

Figure 15:
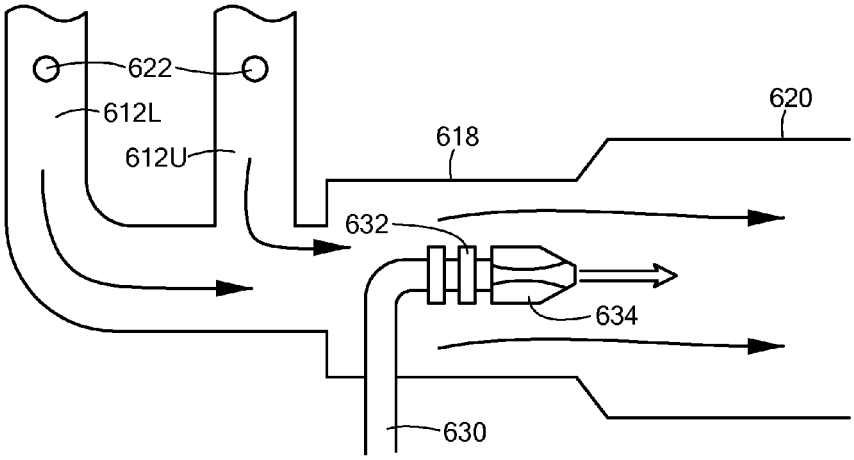
FIG. 15 is an exhaust system in accordance with one embodiment of the present invention.

Referring now to FIG. 15, the mechanism for providing the suction force for pulling the processed gas out of the zone 606 is presented. A right angle high pressure pipe 630 is inserted in the sidewall of the Venturi section 618. A compression fitting 632 is coupled to a distal end of the high pressure pipe 630 and an air nozzle 634 is coupled to the compression fitting 632. In one embodiment, the air nozzle is a Model 1103SST Super Air Nozzle available from Exair Corporation of Cincinnati, Ohio.

In operation, high pressure air on the order of 80 psi is provided into the proximal end of the high pressure pipe 630 and ejected from the air nozzle 634. Due to the Venturi effect, this creates a draw behind the air coming out of the air nozzle 634 and causes air to be drawn in through the holes 622. Advantageously, using the air nozzle 634 at this air pressure level provides sufficient movement of air, on the order of approximately 71 cubic feet per minute, while also providing relatively quiet operation in that the sound level coming from the system, as measured at the output of the exhaust stack 620 is approximately 77 dB.

In an alternate embodiment, rather than the high pressure pipe 630 being provided at a right angle to the connector 632 and the nozzle 634, the pipe 630 may be provided in line.

Advantageously, cooling the heating lamps 604 by the process gas provides several benefits. The cooled IR heating lamps 604 provides shorter wavelengths of emitted infrared light, the shorter wavelengths being in a wavelength range that improves the heating of silicon wafers being transported through the furnace. The cooling also improves the lamps lifespan by maintaining a lower temperature on the outer shell of the quartz lamp tubes. Further, the cooling also helps drive the inner element temperature higher which runs the lamps at a shorter wavelength, as above. The shorter wavelengths help to heat up the wafers with a very steep temperature gradient. With a steep temperature gradient, the process time is kept to a minimum and the steep temperature ramps are used to avoid unwanted diffusion which can affect cell lifetime and efficiency. Still further, cooling the lamps by moving the process gas over them also provides for the evacuation of residues and better profile control due to the separation between the sections and air turnover. The process gas that serves as the cooling gas for the lamps may be introduced into the top and bottom of the chamber at room temperature. In another embodiment, the process gas may be introduced at a temperature that is lower than room temperature to provide even more of a cooling effect.

Figure 12:
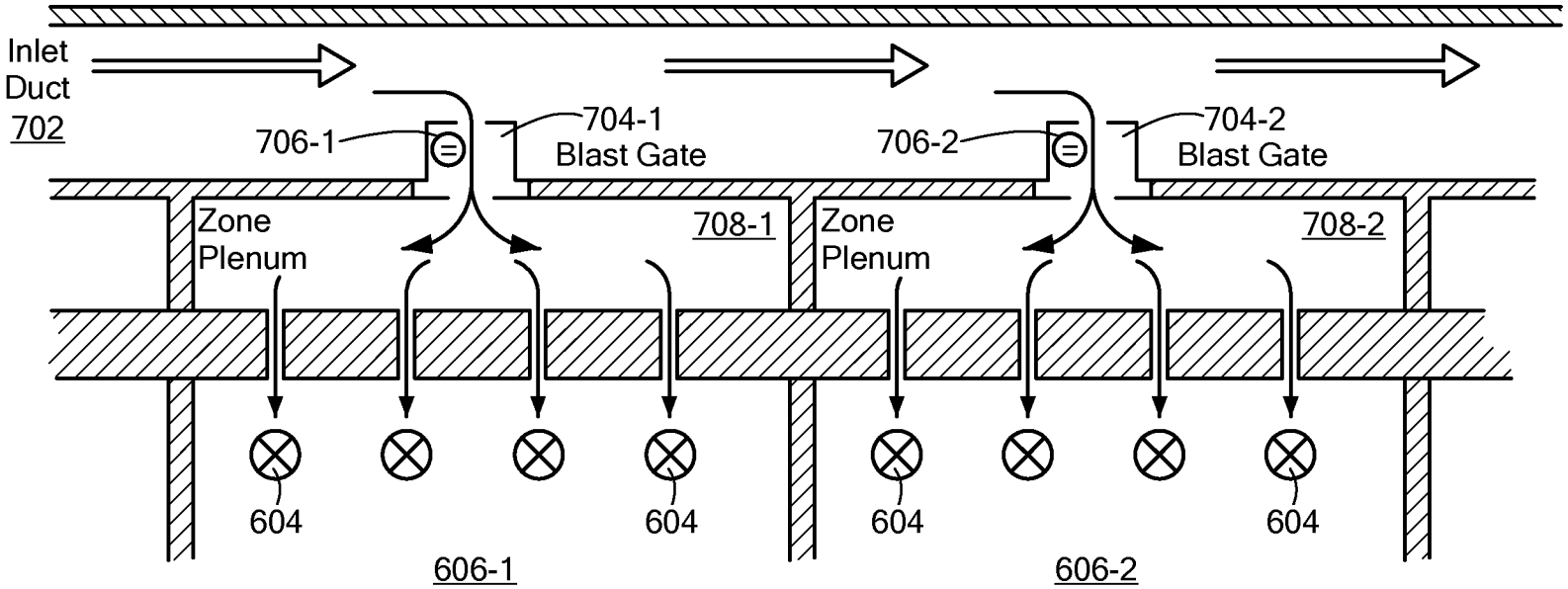
Figure 13:
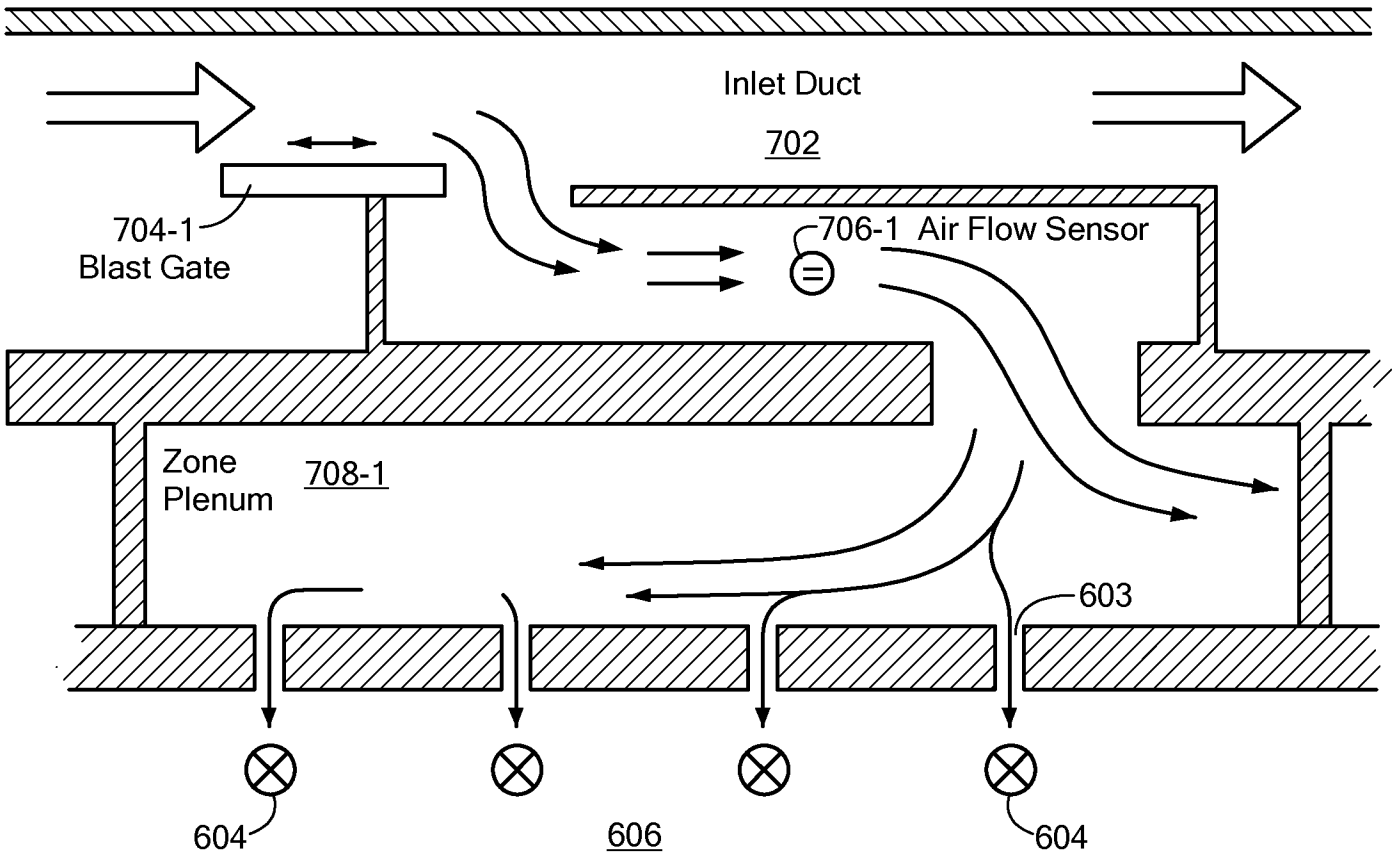

Referring now to FIGS. 12 and 13, the process gas is introduced into an inlet duct 702 and controlled by a blower (not shown) running at flow rates that are 5-150 times higher than conventional systems. A benefit of this high flow rate is improved profile control and better evacuation of the solvent and/or organics coming off the paste on the wafers. A blast gate 704 is provided within the inlet duct 702 to control the amount of moving process gas that is then conveyed into a zone plenum 708 for each respective subzone 606. A flow meter 706 is provided within the blast gate 704 in order to monitor and control the flow of the process gas being brought into the zone plenum 708. From the zone plenum 708, the moving process gas is directed through a plurality of slots 603 to move across respective IR heating lamps 604.

Each subzone may have its own respective blast gate 704 to allow a specific amount of process gas into the zone plenum 708 and from there to pass by the infrared heating lamps 604. Advantageously, each blast gate 704 may be individually controlled so as to provide the proper operating characteristics as desired within a specific subzone 606 of the burnout/firing section 104.

Figure 16:
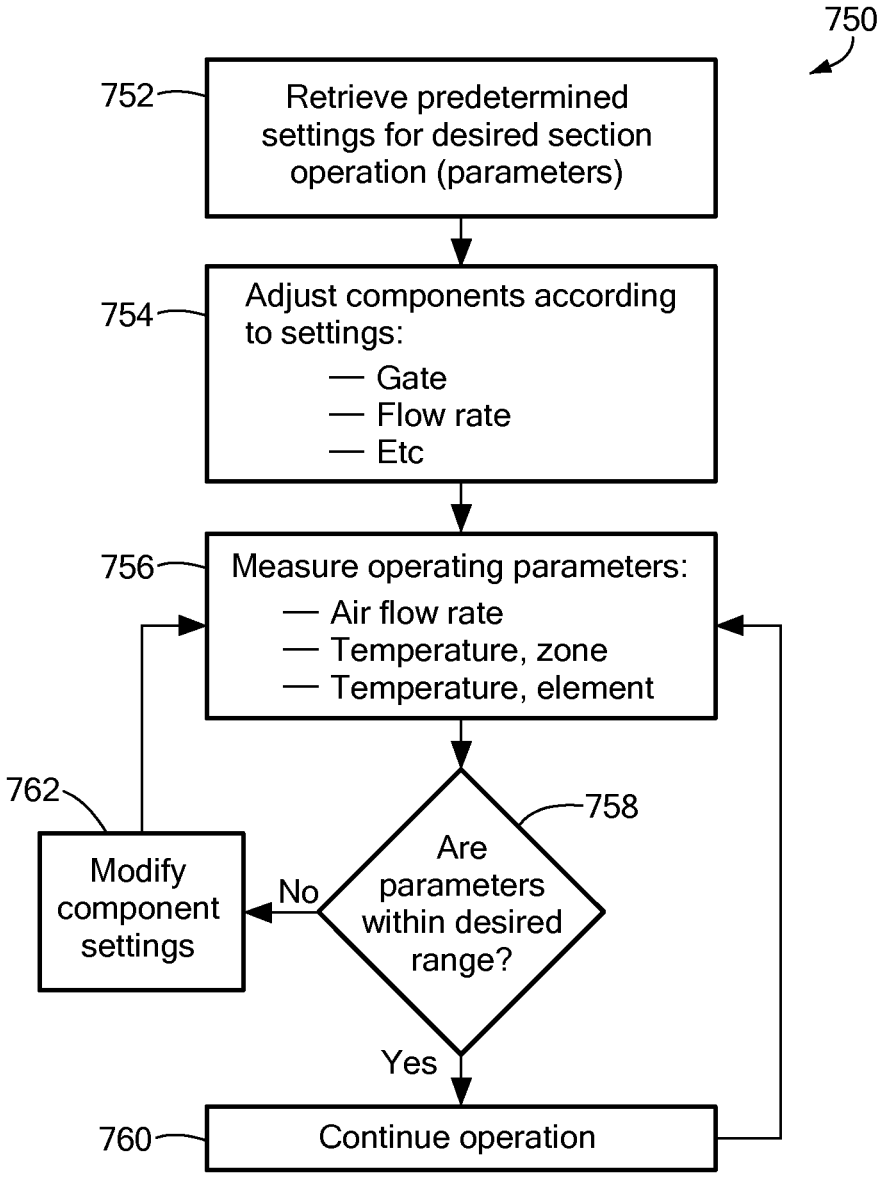
FIG. 16 is a method in accordance with an embodiment of the present invention.

Referring now to FIG. 16, a process 750 to control the process gas running in a section will now be described. Initially, step 752, the predetermined settings for desired section operation are retrieved from, in one embodiment, a computer-based control system (not shown) having volatile and non-volatile storage thereon. These settings may include, for example, the flow rate as measured by the flow meter 706, the temperature desired in the subzone 606 and/or any other process parameter that may be measurable or controllable. The profiles may be predefined and stored as "recipes" in memory or storage for later selection and use. A "recipe" may serve as the "base" for a process where, however, some of the process parameters are modified or adjusted by a user for a particular process. The "new" or "modified" recipe can then be stored as a new "base" recipe for subsequent use by the same or another user.

Subsequently, step 754, the components are adjusted in order to arrive at the desired performance characteristics. The adjustments may include setting the opening of the blast gate 704, controlling the speed of the blower in the inlet duct 702 or setting a power level in the infrared heating lamp 604. Control of the process includes, step 756, measuring the operating parameters including, but not limited to, the actual air speed within the blast gate 704, the temperature within the zone 606, as well as the temperature of the individual infrared heating lamps 604. These measured operating parameters are compared to the desired parameter range, step 758, to determine if the furnace is operating at the desired process point. If the measured parameters are within range, control passes to step 760 which continues operation and returns to the measuring operating parameters of step 756. Returning now to step 758, if the parameters are not within a desired range then the component settings are modified, step 762, to bring operation into conformance with desired results and control passes back to measuring the operating parameters of step 756.

As a result, steeper heating profiles can be provided within a subzone and the operating life of the IR heating lamps 604 can be increased due to the flow of the process gas.

Figure 17:
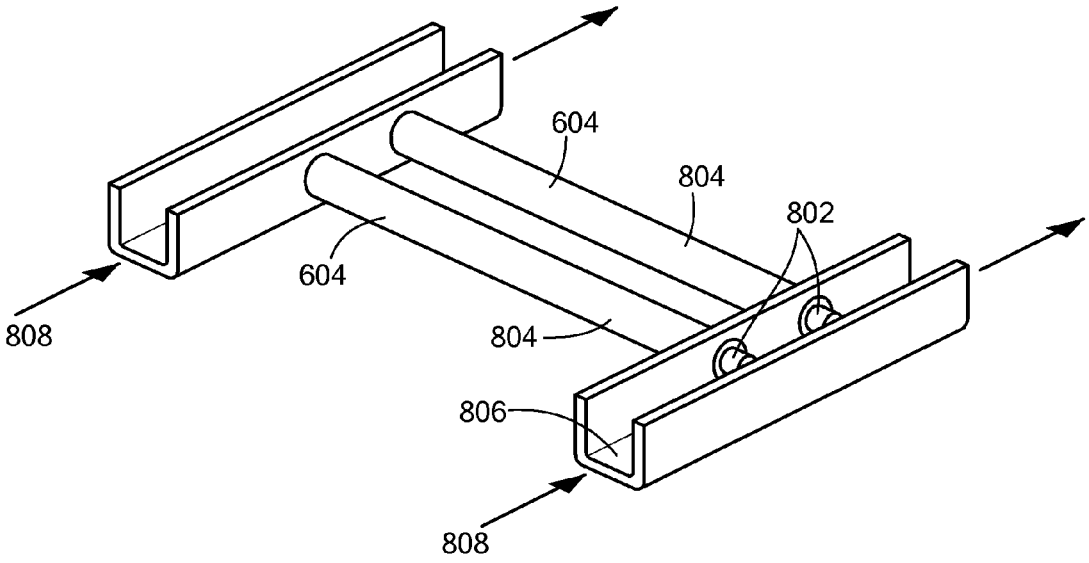
FIG. 17 is a perspective view in accordance with an embodiment of the present invention for maintaining temperature of ends of heating lamps.

As referenced above, the infrared lamps 604 are generally tubular in shape and have end terminals 802 disposed in a spaced array along an upper portion and/or a lower portion of the burnout/firing section 104, as shown in FIG. 17. The terminal ends 802 of the lamps 604 are disposed within respective cooling ducts or conduits 806 in which flowing air or other gases cool the end terminals 802 of the lamps 604. The cooling of the lamp end terminals 802 improves the lamp life because lamp life tends to be longer with lower end seal temperatures.

Figure 18:
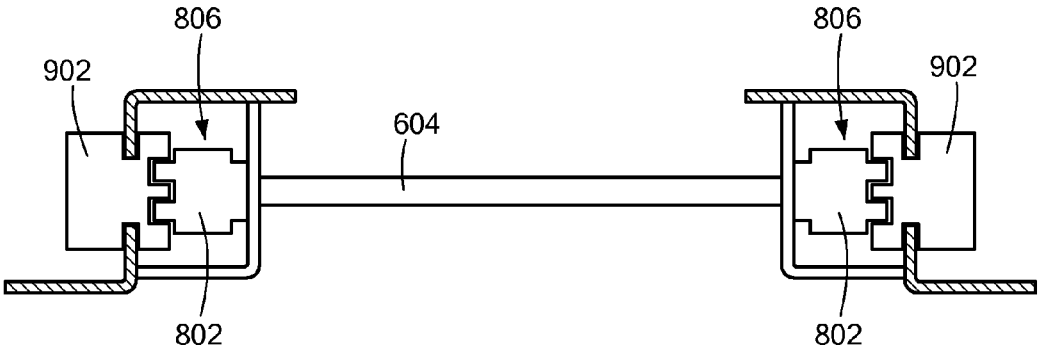
FIG. 18 is an alternate view of the embodiment shown in FIG. 17.

Further, referring now to FIG. 18, as the end terminals 802 are plugged into connectors 902, the cooling of the lamp ends 802 also allows for maintaining an improved electrical connection between the end terminals 802 and the connectors 902 by reducing oxidation buildup on the electrical contacts within the connectors 902. In another embodiment, the cooling of the lamp end terminals 802 maintains them at an operating temperature of about 80°-120° C. In one embodiment of the present invention, the cooling air is provided by a blower which introduces air flowing through the cooling ducts 806. The air circulating in the cooling ducts 806 may be part of a closed system in that the same air is circulated around but re-cooled before passing over the lamp end terminals 802 again. Alternately, "fresh" air may be pulled in from outside the duct prior to being passed over the terminals 802 and then vented out afterward.

Generally, as described above the heating lamps 604 are disposed across the conveyor belt. In one embodiment, straight tubular heating lamps 604 are provided. These heating lamps 604 are mounted in spring loaded connectors to receive and orient the lamp 604 over the conveyor belt. As known to those of ordinary skill in the art, the connectors are configured to interface with the end terminals 802 of the lamps 604. Thus, the configuration of these connectors are known and adapted to the requirements of the particular types of heating lamps 604 used in the system.

In order to facilitate the insertion and removal of the heating lamp 604, one embodiment of the present invention provides a mechanism that allows single-handed removal of a tubular lamp 604.

Figure 19:
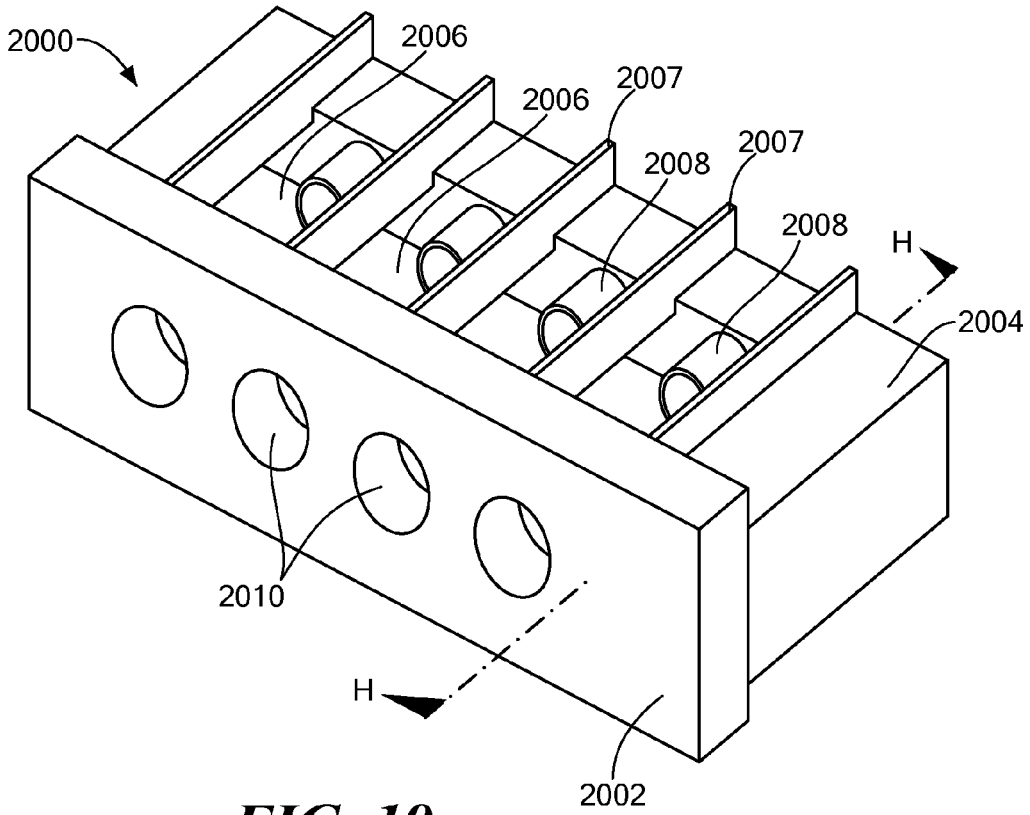
FIG. 19 is a perspective view of a trigger support in accordance with one embodiment of the present invention.

Referring now to FIG. 19, a trigger support 2000 is shown. The trigger support 2000 includes a trigger support front panel portion 2002 and a trigger support back portion 2004 coupled to one another. In one embodiment, the trigger support front portion 2002 and the trigger support back portion 2004 are made from a high strength plastic material. The choice of material for the trigger support 2000 and its related parts would be determined in accordance with the environment in which the trigger support is (or will be) operated and falls within the abilities of one of ordinary skill in the art.

A plurality of trigger pods 2006 are defined in the trigger support back portion 2004 and are delineated by separating fins 2007. Here, strictly for explanatory purposes, 5 (five) separating fins 2007 are shown in order to demarcate 4 (four) trigger pods 2006. Each trigger pod includes a trigger spring guide 2008 whose function will be described in more detail below. A plurality of trigger openings 2010 are provided in the trigger support front portion 2002. There is one trigger opening 2010 for each trigger pod 2006 and the trigger opening 2010 is aligned with the trigger spring guide 2008.

Figure 20:
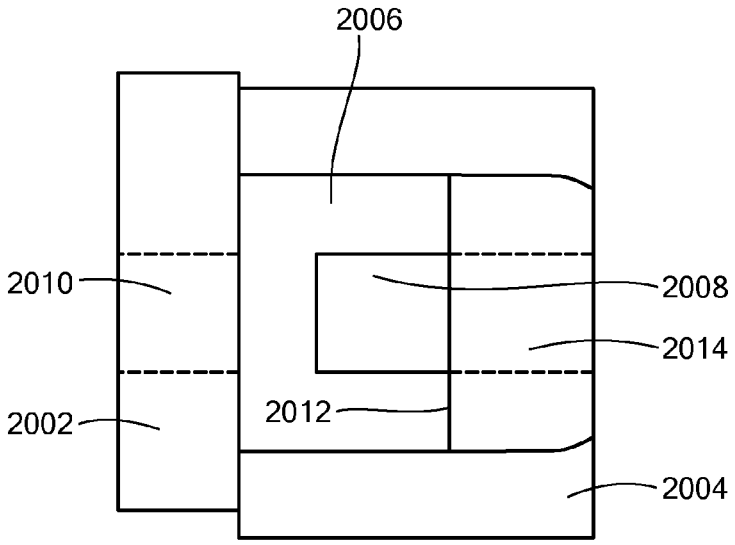
FIG. 20 is a side view of the trigger support shown in FIG. 19.

As shown in FIG. 20, a cross-sectional depiction of the trigger support 2000 taken along the line H-H in FIG. 19, the trigger spring guide 2008 is a hollow cylinder made from the same material as the trigger support 2000. A trigger cable conduit 2014 is provided in the trigger support back portion 2004 and aligned with the cylindrical trigger spring guide 2008. Thus, the trigger opening 2010, aligned with the trigger spring guide 2008 and the trigger cable conduit 2014 define a cylindrical opening. As shown, the trigger spring guide 2008 is provided at a spring stop wall 2012 of the trigger support back portion 2004.

Figure 21:
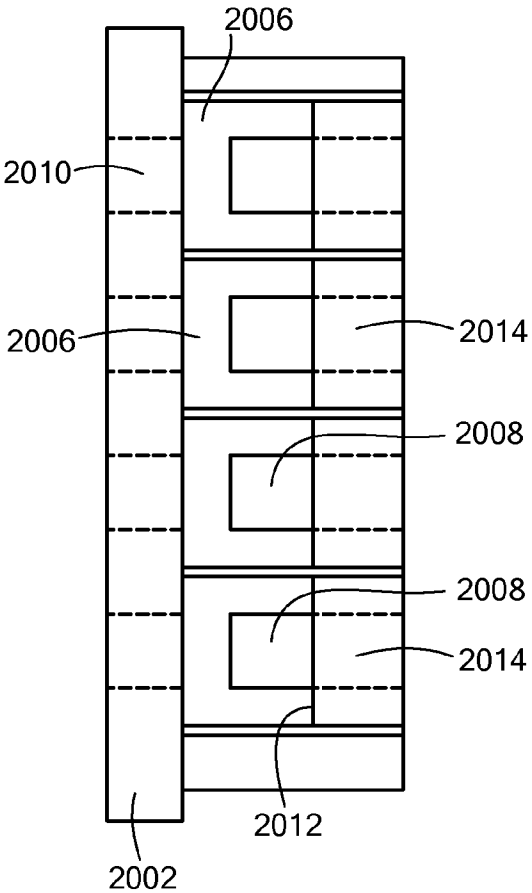
FIG. 21 is a top-view of the trigger support shown in FIG. 19.

FIG. 21 is a top view of the trigger support assembly 2000 shown in FIG. 19. Here, as also shown in FIG. 20, the alignment of the trigger opening 2010, the trigger spring guide 2008 and the trigger cable conduit 2014 is viewed from above.

Figure 22:
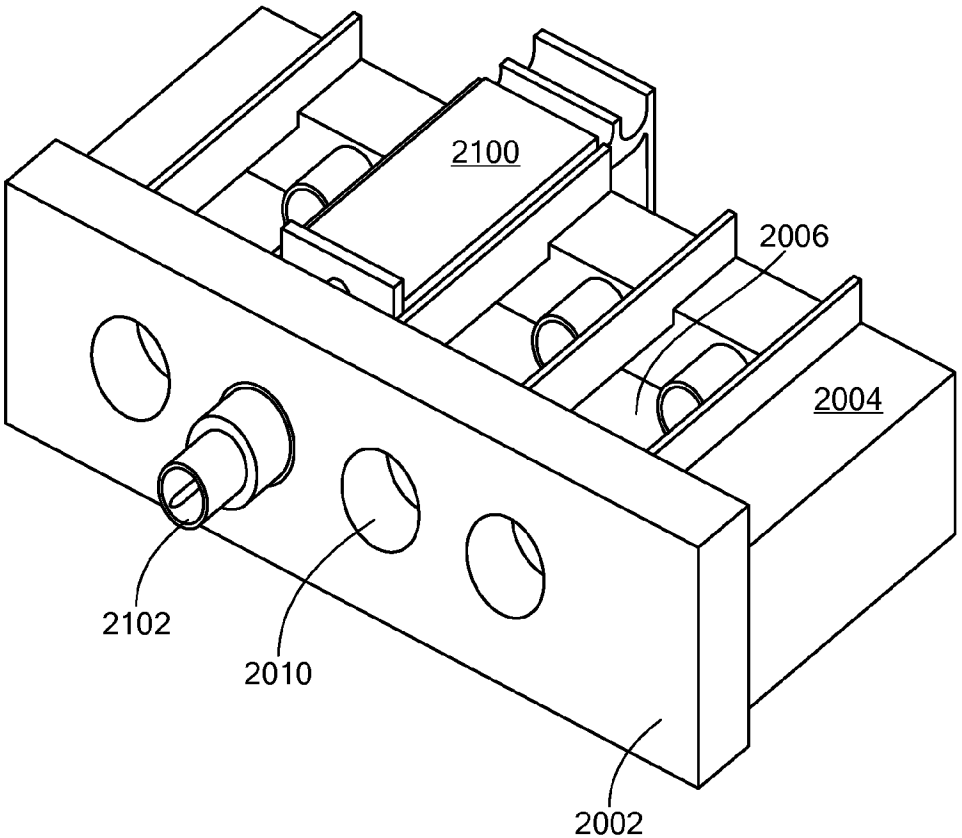
FIG. 22 is a perspective view of a lamp trigger mounted in a trigger support.

In order to facilitate the provision of power to a respective heating lamp 604, an appropriate lamp connector must be provided. The trigger support 2000 provides the trigger pods 2006 to receive a respective trigger 2100 as shown in FIG. 22. The trigger 2100, which will be described in more detail below, includes a lamp connector 2102 that, when the trigger 2100 is provided in a trigger pod 2006 of the trigger support 2000, protrudes through a respective trigger opening 2010 to be in contact with a respective lamp.

Figure 23:
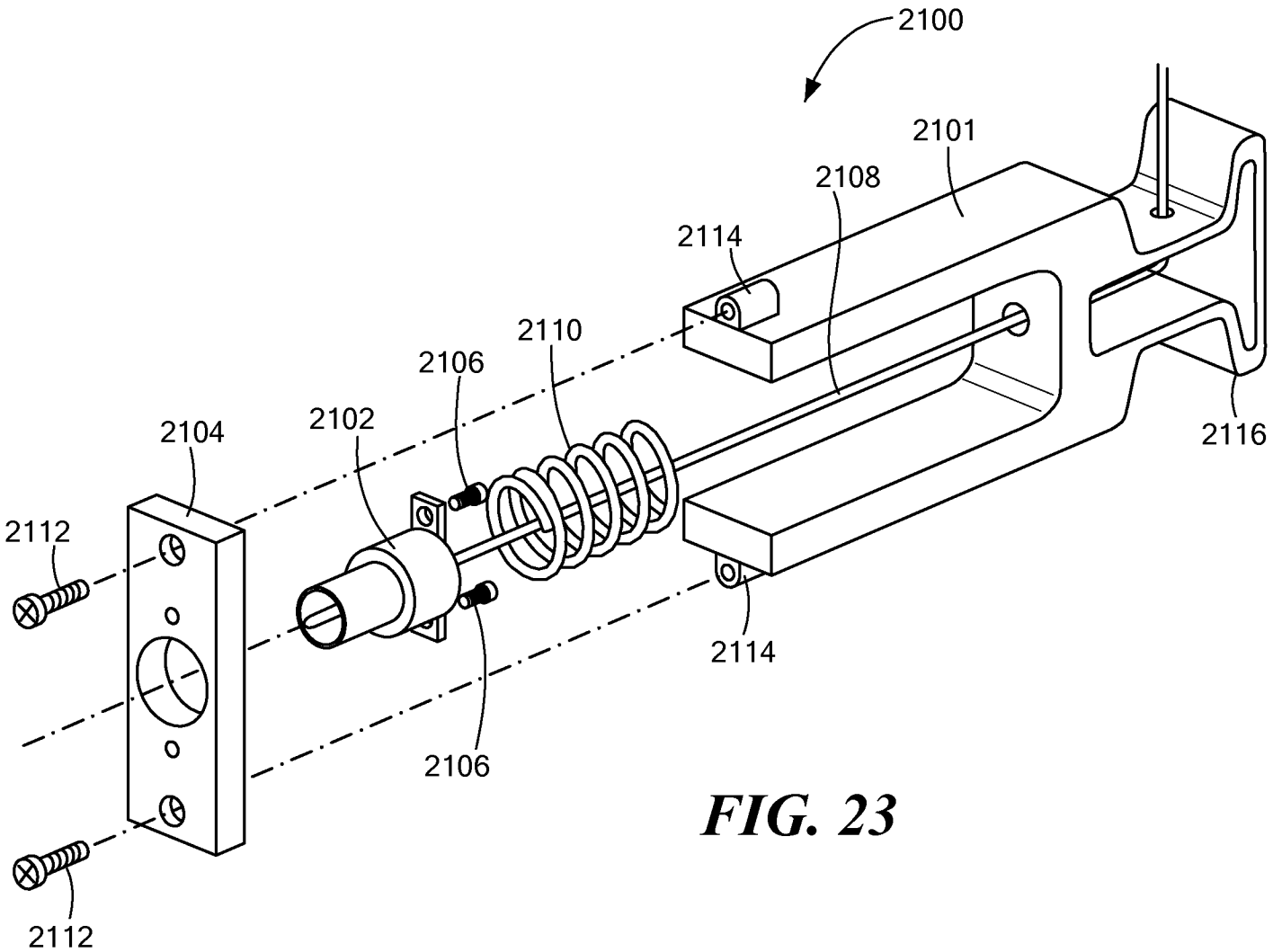
FIG. 23 is an exploded view of a lamp trigger.

Referring now to FIG. 23, the trigger 2100 includes a U-shaped trigger frame 2101 made from a high strength material, for example, plastic, similar to the material used for the trigger support frame 2000. The lamp connector 2102 is mounted to a trigger faceplate 2104, usually made of metal. One or more rivets 2106 are used to attach the lamp connector 2102 to the trigger faceplate 2104. A power wire 2108 is electrically coupled to the lamp connector 2102 and fed through the trigger frame 2101. A trigger spring 2110 is provided and is used to bias the trigger 2100 into position within the trigger frame 2000, as will be described below. A couple of screws 2112 are used to attach the trigger faceplate 2104 to the trigger frame 2100 by interaction of the screws 2112 into corresponding receptacles 2114 located on the trigger frame 2101. To facilitate operation of the trigger 2100 within the trigger support 2000, the trigger frame 2101 includes a trigger handle 2116 having a shape for easy manipulation by an operator's hand.

Figure 24:
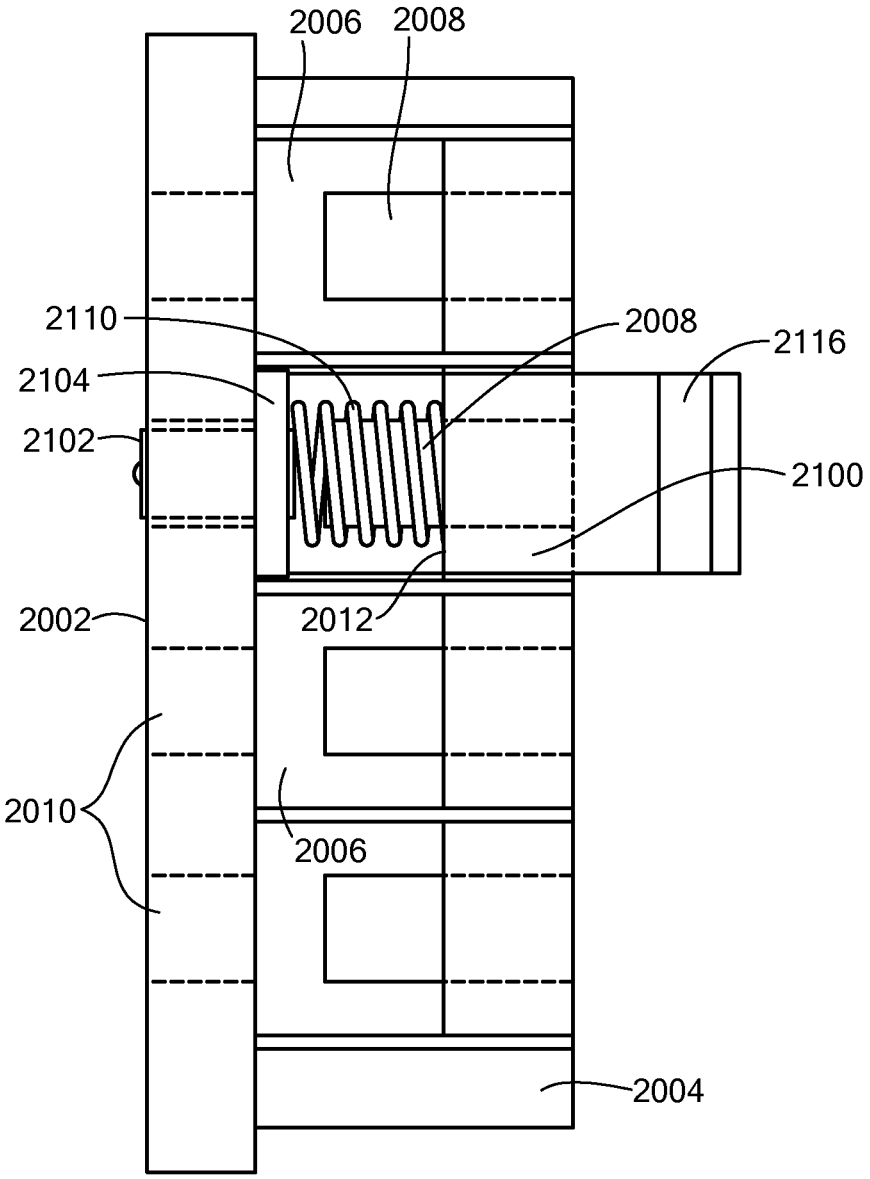
FIG. 24 is a top-view of the lamp trigger mounted in the trigger support as shown in FIG. 22.

FIG. 24 is a top view of the trigger 2100 positioned within a trigger pod 2006 of the trigger support 2000. The trigger spring 2110 is positioned such that one end is located about the trigger spring guide 2008 while the other end pushes against the trigger faceplate 2104 of the trigger 2100. The trigger spring 2110 pushes against the spring stop wall 2012 thus causing the lamp connector 2102 to protrude through the trigger opening 2110 located in the trigger support front portion 2002.

It should be noted that the lamp connector 2102 itself has an internal spring that provides for some amount of accommodation when a lamp is connected to the lamp connector 2102. This spring within the lamp connector 2102 is not shown as, in general, the lamp connector 2102 is provided as a single piece for incorporation into the trigger 2100.

Further, while only one trigger 2100 is shown, one of ordinary skill in the art would understand that in operation there would be a trigger 2100 in each trigger pod 2006. Further, while only four trigger pods are shown, it is well understood that any number could be provided in a trigger support 2000 as required by a specific design.

Figure 25:
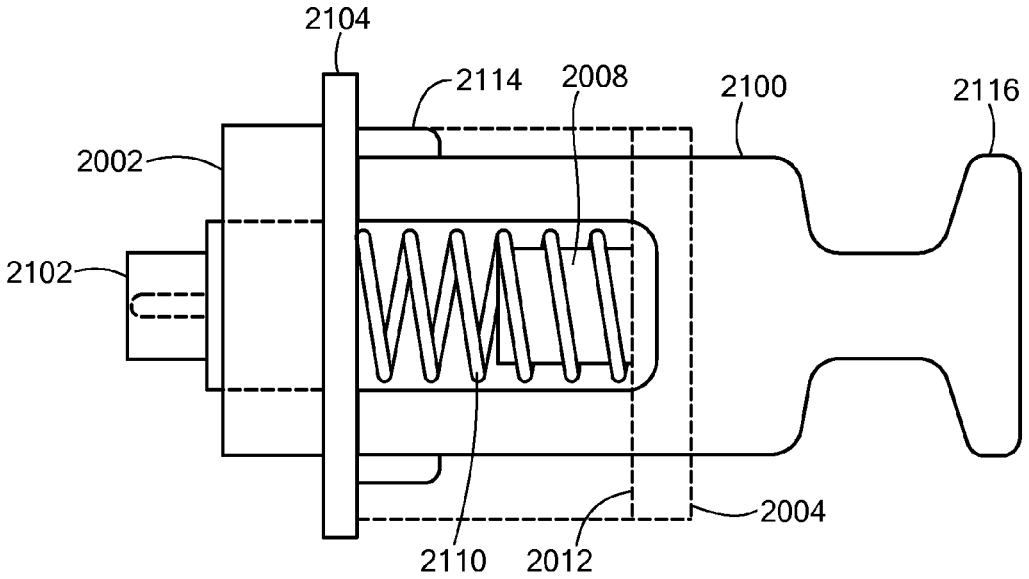
FIG. 25 is a side-view of the lamp trigger mounted in the trigger support in the position for supporting a lamp.

As described above, the trigger's normal position, due to the biasing of the trigger spring 2110 against the spring stop wall 2012 causes the trigger lamp connector 2102 to couple with a heat lamp (not shown) as depicted in FIG. 25. While the exploded view of the trigger presented in FIG. 23 did not show the trigger support 2000, one of ordinary skill understands how the trigger 2110 is assembled and integrated into the trigger support 2000 such that the trigger spring 2110 is coupled to the trigger spring guide 2008 in order to bias the trigger lamp connector 2102 properly.

Figure 26:
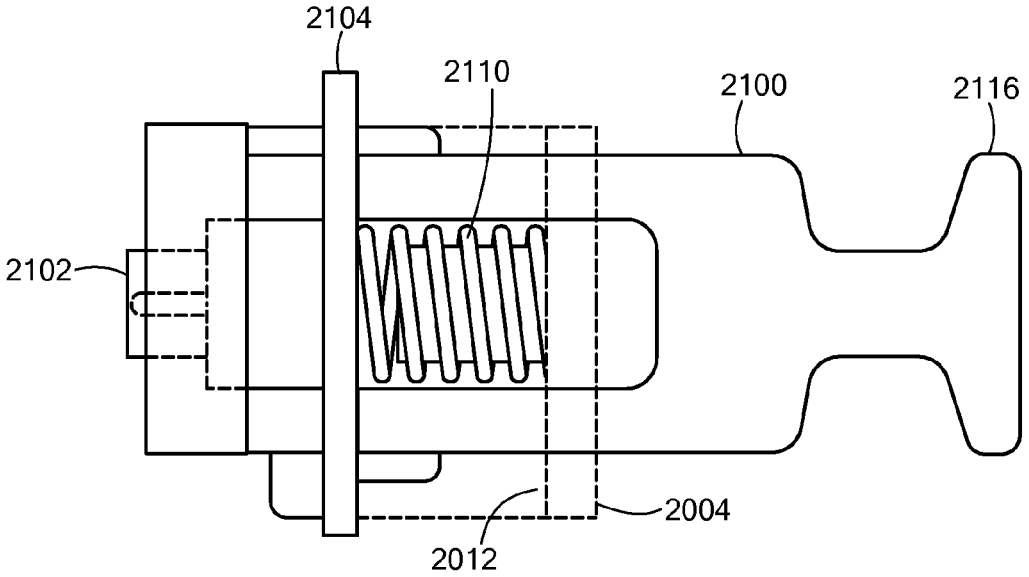
FIG. 26 is a side-view of the lamp trigger in its withdrawn position within the trigger support.

In order to remove a lamp, the trigger 2100 is moved in a direction opposite to the urging force provided by the trigger spring 2110. Doing so pulls the trigger lamp connector 2102 away from the lamp to which it is connected and allows for the removal of the lamp from the system. The trigger handle 2116 facilitates the pulling of a specific trigger 2100 especially where a plurality of triggers 2100 are provided, i.e., one next to each other, within a trigger support 2000. As shown in FIG. 26, when the trigger 2100 is pulled "back" the trigger lamp connector 2102 is withdrawn through the trigger opening 2010 which facilitates the removal and replacement of the lamp. Returning the trigger 2100 to its normal position, once a replacement lamp (if any) is inserted, provides for a sufficient amount of pressure to maintain the lamp in position. Of course, one of ordinary skill in the art will understand that the characteristics of the trigger spring 2110 are chosen to provide sufficient force to maintain the lamp in position without presenting a force that is difficult to overcome by a person pulling in the opposite direction.

Figure 27:
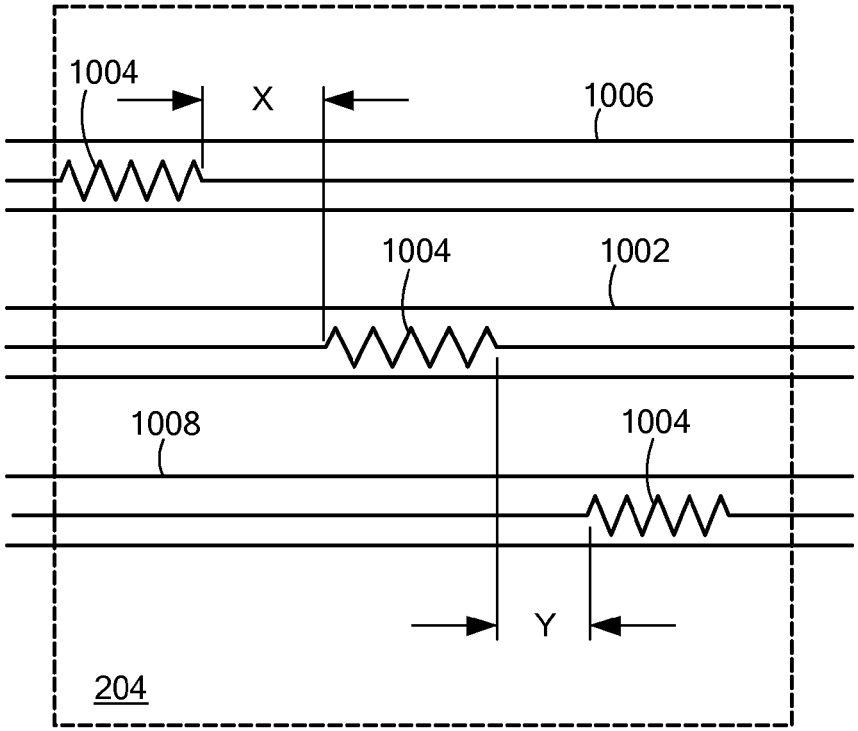
FIG. 27 is a view of heating lamps with offset filaments in accordance with one embodiment of the present invention.

In an alternate embodiment of the present invention, infrared lamps or tubes having offset filaments are used. As shown in FIG. 27, an infrared heating lamp 1002 is provided having a centered filament 1004 where the maximum heat provided by the lamp 1002 is at its center. In addition, a left-handed lamp 1006 is provided where its filament 1004 is located, as oriented in the drawing, on the left hand side of the drawing at which its peak heat would be located. A right handed infrared lamp 1008, having its filament 1004 on the right side is also provided. It should be noted that the right-handed infrared lamp 1008 may be a left-handed lamp 1006, just switched around, however, there may be non-symmetric right-hand and left-hand lamps. The length of any given filament may be adjustable as well as the relative location of the centered, right-hand, and left-hand lamps with respect to each other such that the distances between, or the over-lap, values X and Y, can be adjusted to provide a profile across the belt 204 as required by a particular process.

Figure 28:
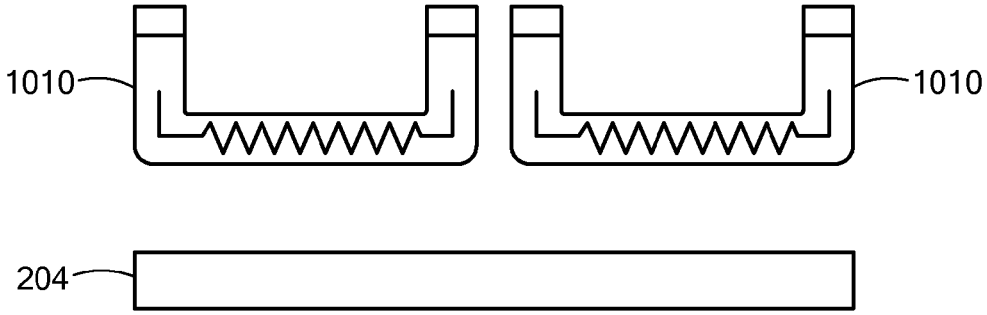
FIG. 28 is a view of U-shaped heating lamps in accordance with one embodiment of the present invention.

Alternately, as shown in FIG. 28, U-shaped lamps 1010 may be provided in order to heat a workpiece moving along underneath on the conveyor belt 204. Here, the belt 204 is shown as moving into the page.

Of course, one of ordinary skill in the art, will understand that the orientation and combination of the U-shaped lamps 1010 and any of the offset lamps 1002, 1006 and 1008 are envisioned by this description.

Further, the infrared heating lamps are not limited to single filament devices as a tube having, for example, a "FIG. 8" or twin tube format such as is available from Heraeus Noble Light Corporation of Duluth, Ga. may be used. The shortwave twin tube heater available from Heraeus includes configurations where multiple filament tubes are provided to result in overlapped or displaced heating profiles.

Figure 29:
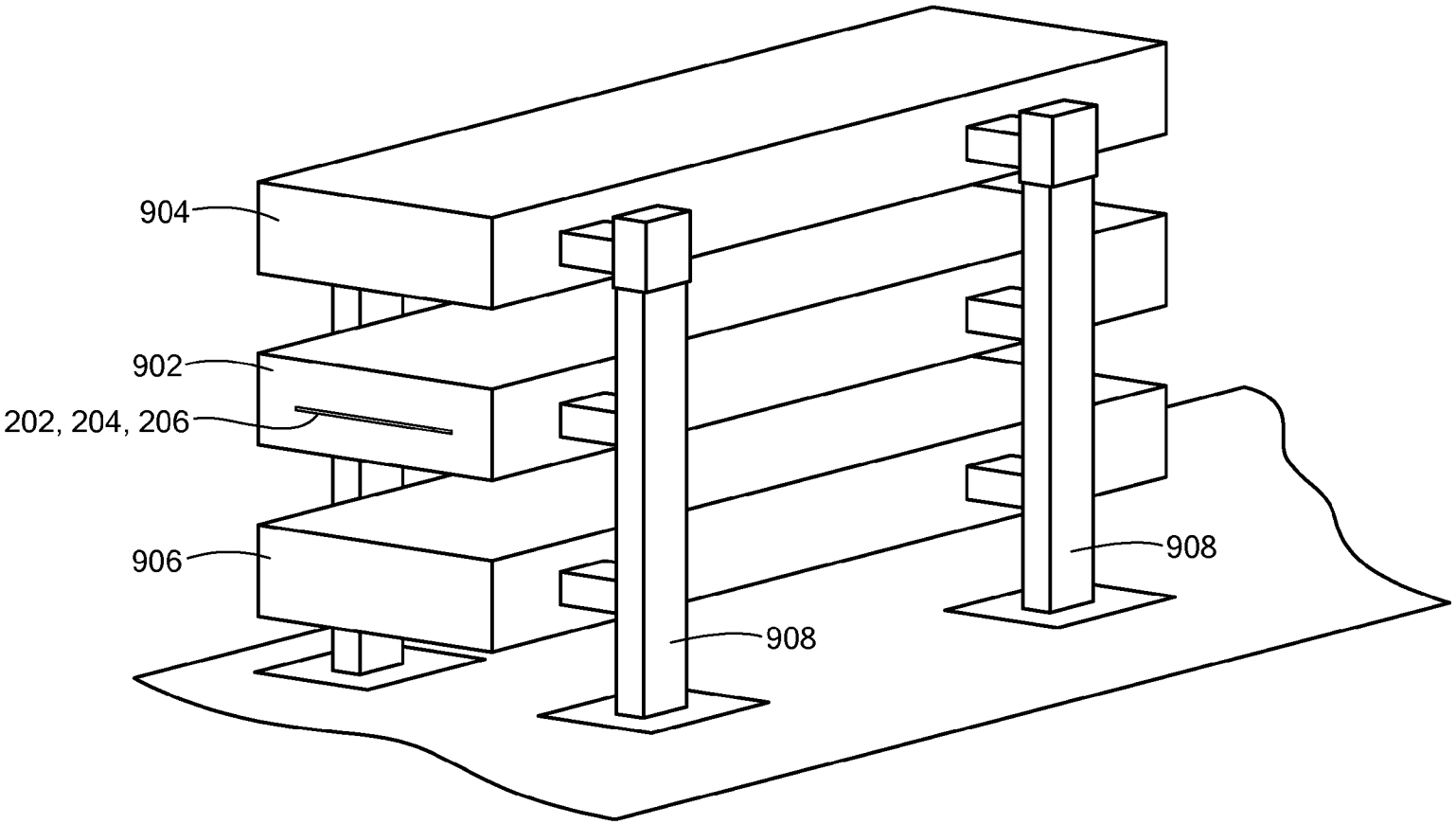
FIG. 29 is a view of another embodiment of the present invention.

Each of the dryer section 102, burnout/firing section 104, and cooling section 106 may have an upper and lower housing portion that can be moved in order to provide access to components of the associated section. As shown in FIG. 29, a central portion 902 may encompass the respective conveyor belt 202, 204, 206 and related mechanical components. An upper housing portion 904 and lower housing portion 906 are attached to lifting and lowering actuators 908 in order to move the upper and lower housing portions 904, 906 into or out of position for allowing access to within the section. The lifting and lowering actuators 908 could be either electric or hydraulic. Of course, one of ordinary skill in the art will understand that the upper or lower housing portion 904, 906 may be moved into or out of operating position independently from the other. This allows for ease of access as well as observation of the interaction of any components of the system.

It is not intended that the depictions of the conveyor belts in the drawings represent them as being of a solid material, and the conveyor belts are not so limited. It is envisioned that the conveyor belts may consist of a mesh material made of appropriate material with a pattern having an appropriate size. Further, the belt material and mesh pattern in one section may be different from the belt material and mesh pattern in another section to accommodate the respective section's function and operating conditions.

An infrared furnace system has been described that provides for drying, heating and cooling a wafer as it moves through the furnace over multiple conveyor belt systems. The furnace comprises an enclosure having top, bottom and sidewalls and an entrance and an exit portion. The first conveyor belt system is contained within the dryer section and transfers the wafer along the length of the dryer section. The speed of the conveyor belt is a function of the amount of time the wafer is required to remain within the dryer section. If the wafer must be in the dryer section for a certain amount of time, the speed of the conveyor belt can be adjusted and the length of the dryer section shortened to produce the required time the wafer must be contained therein. The second conveyor belt is contained within the firing section and extends from the unloading end of the dryer section to an unloading position at the other end of the firing section. The firing belt speed can be controlled to provide the required amount of time the wafer needs to be contained in the firing section and will allow for the length of the firing section to be as small as possible. The last conveyor belt in the cooling section is contained within the cooling section and its speed can also be controlled to produce the proper amount of time the wafer must remain therein. The length of the cooling section can be reduced accordingly with the conveyor belt speed being adjusted to create the proper amount of time the wafer is to be contained therein.

An infrared furnace system with multiple belts provides versatility of operation by allowing for different types of profiles to be set depending upon the type of workpiece being transported therethrough.

In another embodiment of the present invention, multiple conveyor belts, positioned side-by-side with one another, may be provided in one or more of the sections of the furnace. Each conveyor belt may be set with either the same speed or a different speed as another belt through the same zone. Thus, products with different profile requirements may be processed at the same time where the speed of the belt through a zone determines the heating profile a workpiece will experience.

Having thus described several features of at least one embodiment of the present invention, it is to be appreciated that various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A furnace comprising:

a first section having one or more zones, at least one conveyor for conveying a product, an entrance and an exit;

a second section having one or more zones, at least one conveyor for conveying a product, an entrance and an exit;

a third section having one or more zones, at least one conveyor for conveying a product, an entrance and an exit;

at least one of the first, second and third sections comprising an array of lamps disposed either above or below the respective at least one product conveyor, each lamp comprising an elongated tubular region located between first and second end terminals, each elongated tubular region positioned substantially transverse to a direction of motion of the conveyor; and at least one of the first, second and third sections comprising a process gas system for providing a respective substantially planar flow of process gas directed across a corresponding tubular region of each lamp of the respective section, wherein the process gas system for the at least one section comprises:

a first plenum;

a first plurality of elongated slots fluidly coupling the first plenum and the respective section; and a fluid moving system for directing process gas from the first plenum, through the first plurality of slots, and into the respective section, wherein a respective longitudinal axis of each slot of the first plurality of slots is coplanar with, and aligned parallel to, the elongated tubular region of a respective one of the lamps of the respective section, wherein each lamp is spaced apart from, and arranged between, each respective slot and the conveyor, and wherein the plane defined by the slot and the elongated tubular region is substantially perpendicular to the direction of motion of the conveyor.

2. The furnace of claim 1, wherein at least one of the first, second and third sections comprises a lamp cooling system for cooling the end terminals of the respective lamps.

3. The furnace of claim 2, wherein the lamp cooling system comprises:

a first conduit in which the first end terminals of the lamps are disposed; and a second conduit in which the second end terminals of the lamps are disposed.

4. The furnace of claim 3, wherein the lamp cooling system further comprises:

a blower for providing moving gas through at least one of the first and second conduits, wherein the gas in the lamp cooling system is separate from the process gas.

5. The furnace of claim 4, wherein the lamp cooling system further comprises:

means for cooling the gas coupled to the blower.

6. The furnace of claim 3, wherein at least one of the first and second conduits is a closed system in which gas flowing in the respective conduit is recirculated.

7. The furnace of claim 6, wherein the gas is air.

8. The furnace of claim 1, further comprising:

a process gas source for introducing the process gas into the first plenum, wherein the process gas is coupled from the first plenum, through the first plurality of slots and into the respective section to pass over the lamps.

9. The furnace of claim 1, further comprising:

a first blast gate fluidly coupled with the first plenum, wherein the first blast gate is operable to control an amount of process gas flowing into the first plenum.

10. The furnace of claim 9, further comprising:

a first flow meter disposed in the first blast gate and operable to measure a flow rate of process gas in the first blast gate.

11. The furnace of claim 1, wherein the lamps are spaced along the length of the respective section of the furnace.

12. The furnace of claim 11, wherein each lamp is configured to emit infrared radiation from the elongated tubular region.

13. The furnace of claim 12, wherein each lamp is removable, the furnace further comprising:

a lamp support system coupled to the removable lamps.

14. The furnace of claim 13, further comprising a lamp support system for providing power to the lamps, the lamp support system comprising:

a lamp trigger including an electrical contact for releasable electrical connection to an end terminal of the lamp;

a trigger support frame configured to accept the lamp trigger, the trigger support frame having an opening defined therein to receive the electrical contact; and a spring mechanism coupled to the trigger support frame and the lamp trigger, the spring mechanism configured to urge the electrical contact through the opening and into engagement with the end terminal of the lamp.

15. The furnace of claim 14, wherein the lamp trigger comprises:

a handle portion to facilitate movement of the lamp trigger in opposition to the spring mechanism.

16. The furnace of claim 14, wherein the electrical contact comprises a second spring mechanism to urge the electrical contact into engagement with the end terminal of the lamp.

17. The furnace of claim 14, wherein the lamp support system further comprises:

a power lead electrically coupled to the electrical contact and extending through the lamp trigger.

18. The furnace of claim 1, further comprising:

a first conveyor for transferring the product from the exit of the first section to the entrance of the second section; and a second conveyor for transferring the product from the exit of the second section to the entrance of the third section, wherein each of the first and second transferring conveyors is configured to accommodate product transfer between two section conveyors operating at different speeds.

19. The furnace of claim 18, wherein at least one of the first and second transferring conveyors comprises:

a first plurality of shafts disposed along a travel axis and substantially parallel to each other in a direction orthogonal to the travel axis;

a first drive assembly coupled to the first plurality of shafts and operative to drive the first plurality of shafts at a first speed;

a second plurality of shafts disposed along the travel axis and substantially parallel to one another in the direction orthogonal to the travel axis; and a second drive assembly coupled to the second plurality of shafts and operative to drive the second plurality of shafts at a second speed;

wherein each of the first plurality and second plurality of shafts has at least one roller coaxially and freely rotatably disposed on the shaft.

20. The furnace of claim 19, wherein:

the first drive assembly is configured to drive the first plurality of shafts at a speed substantially the same as a speed of the first section conveyor; and the second drive assembly is configured to drive the second plurality of shafts at a speed substantially the same as a speed of the second section conveyor.

21. The furnace of claim 19, wherein:

each of the first and second plurality of shafts has a pair of rollers coaxially disposed and freely rotatable on the shaft, and wherein each roller in the pair of rollers is configured to center the product between the two rollers.

22. The furnace of claim 21, wherein each freely rotatable roller is passively driven by its respective shaft, and wherein a friction force between the freely rotatable roller and its respective shaft is overcome by a force of a conveyed product disposed thereon such that the freely rotatable roller will spin to match the speed of the conveyed product.

23. The furnace of claim 1, wherein at least one of the first, second and third sections comprises:

an exhaust system for removing gas from at least one of the first, second and third sections.

24. The furnace of claim 23, wherein the exhaust system comprises:

an exhaust pier;

a first exhaust pipe provided in the exhaust pier, the first exhaust pipe having a plurality of openings defined therein, the first exhaust pipe fluidly coupled to the respective section via the plurality of openings;

a Venturi tube fluidly coupled to the first exhaust pipe;

an input pipe having a first end located within the Venturi tube; and a high pressure air nozzle disposed in the Venturi tube, the air nozzle having an input and an output, the nozzle input coupled to the first end of the input pipe and the nozzle output oriented to output high pressure air in a direction away from the first exhaust pipe.

25. The furnace of claim 24, further comprising:

a high pressure air source coupled to the air nozzle via the input pipe.

26. The furnace of claim 1, wherein each of the first, second and third section conveyors is operable at a speed independent of the speeds of the other section conveyors.

* * * * *